US008871161B2

(12) United States Patent
Guttman et al.

(10) Patent No.: US 8,871,161 B2
(45) Date of Patent: Oct. 28, 2014

(54) THERMO-CONDUCTIVE REACTION PLATE HOLDER

(75) Inventors: Chen Haim Guttman, Ramat Gan (IL); Raz Zarivach, Beer Sheva (IL)

(73) Assignee: The National Institute for Biotechnology in the Negev Ltd., Beer-Sheva (IL)

( * ) Notice: Subject to any disclaimer, the term of this patent is extended or adjusted under 35 U.S.C. 154(b) by 0 days.

(21) Appl. No.: 13/427,897

(22) Filed: Mar. 23, 2012

(65) Prior Publication Data

US 2013/0251606 A1 Sep. 26, 2013

(51) Int. Cl.
*B01L 9/00* (2006.01)
*B01L 7/00* (2006.01)

(52) U.S. Cl.
CPC ... *B01L 9/00* (2013.01); *B01L 7/00* (2013.01); *B01L 9/523* (2013.01); *B01L 2200/142* (2013.01); *B01L 2300/185* (2013.01); *B01L 2300/0829* (2013.01)
USPC ..... 422/560; 422/565

(58) Field of Classification Search
USPC ..... 422/560, 565
See application file for complete search history.

(56) References Cited

U.S. PATENT DOCUMENTS

2003/0116497 A1* 6/2003 Carlson et al. ..... 210/435

* cited by examiner

*Primary Examiner* — Natalia Levkovich
(74) *Attorney, Agent, or Firm* — Graeser Associates International Inc; Dvorah Graeser

(57) ABSTRACT

The present invention relates to a reaction plate holding device and system associated therewith for controlling the environment surrounding a reaction plate, and in particular, to a bench-top reaction plate holder providing a controllable environment that fully surrounds a reaction plate.

21 Claims, 17 Drawing Sheets

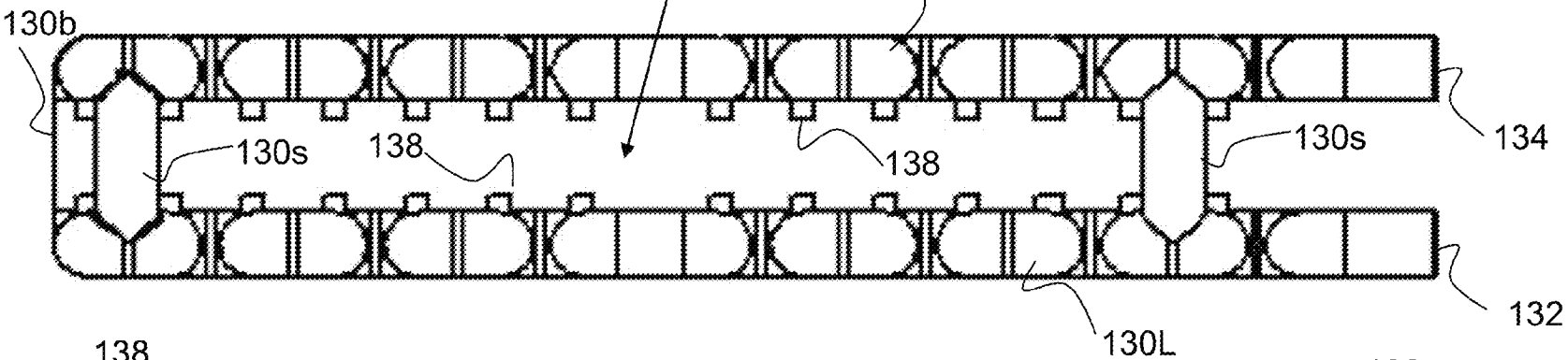
FIG. 7C
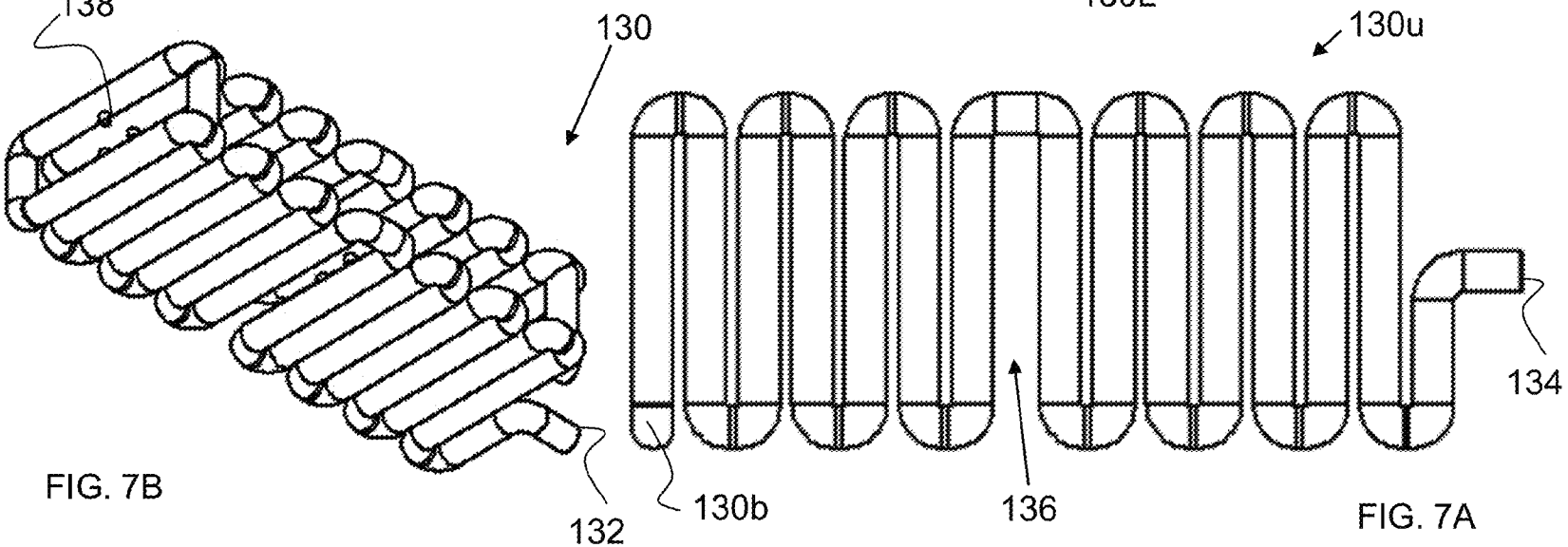
FIG. 7A
FIG. 7B

THERMO-CONDUCTIVE REACTION PLATE HOLDER

FIELD OF THE INVENTION

The present invention relates to a thermo-conductive reaction plate holding device and system associated therewith for controlling the temperature of a reaction plate, and in particular, to a laboratory bench-top to thermo-conductive reaction plate holder providing a controllable environment that surrounds a reaction plate.

BACKGROUND OF THE INVENTION

Many experimental and laboratories settings require careful temperature and evaporation control of reaction mixtures, reagents, analyte, in order to carry out the appropriate experimentation and/or reaction to carry out the required tests, perform reaction, or produce a reaction yield.

Such tight temperature and evaporation control is true for most if not all laboratory setting but is of particular importance in modern day biotechnology and/or biochemical laboratory settings where careful control of the temperature is required at almost all stages of experimentation.

Some laboratory applications, for example PCR, protein crystallography, in-vitro biochemical assays, require varying types of environments for an analyte. For example, some applications and/or analyte demand rapid and/or instantaneous temperature controlled settings; while other analyte and/or applications require gradual temperature controllable settings, and others require temperature cycling between hot and cold environments.

Other experimental protocols may require an analyte be exposed to particular temperature within a given time frame in order to produce a sought after effect. Therefore in some instances following mixing of reagents an experimental reaction must be performed within an incubator or on ice or the like temperature controlled environment.

Many such reaction and experiments readily use a pipette to distribute and dispense reagents within a reaction plate. The reaction plate most readily used in laboratory setting and in particular biochemical settings is a multi-well plate, for example a 96-well plate arranged in an 8 by 12 matrix. Each such multi-well plate provides a plurality of wells for receiving fluids and in which the wells are regularly arranged in two-dimensional arrays made up of columns and rows intersecting each other at right angles (matrix). Such plates are generally intended for single-use only made of plastic.

Various instruments have been developed to attempt to control the temperature of such multi-well reaction plates. Automation and use of robots have been introduced to attempt to gain such temperature control of a reaction plate. Other low tech solutions utilized in labs include placing plate on crushed ice, water baths or incubators.

Similar solutions involve placing the reaction plate in contact with a metal block that is heated and/or cooled with a closed-loop liquid heating/cooling system by circulates a heat transfer fluid through channels machined into the block.

Still further such solutions have been adapted to provide different thermal environments for different reaction vessels by attempting to control temperature of individual reaction wells or areas within the reaction plate.

SUMMARY OF THE INVENTION

Such solutions are unable to reliably achieve temperature uniformity across the reaction plate and do not provide for effectively sealing the reaction plate so as to avoid and/or minimizing evaporation and exposure to airborne contaminates such as dust about a reaction plate. Furthermore, devices provide for temperature control are limited in that they provide temperature control about a single surface, usually the lower surface of the reaction plate.

There is an unmet need for a thermo-conductive reaction plate holder that provides both for controlling the thermal environment surrounding and about a reaction plate while essentially sealing the reaction plate, providing for evaporation control and contamination control from airborne contaminants. The present invention overcomes the deficiencies of the background by providing a device and system that provides a low-cost lab bench tabletop temperature control environment that fully surrounds a reaction plate, therein maintaining a balanced and controllable temperature about both the upper and lower surfaces of reaction wells, while essentially sealing and/or covering the majority of reaction plate, providing for evaporation control and contamination control from airborne contaminants.

Within the context of this application the thermally insulation polymer may for example include but is not limited to Polyvinyl chloride ('PVC'), Acrylonitrile Butadiene Styrene ('ABS'), Polypropylene ('PP'), polystyrene ('PS'), or the like material thermally insulating materials.

Within the context of this application the terms plate, dish, experimental plate, titer plate, specimen plate, sample plate, ELISA plate, multi-well plate, multi-well sample tray, multi-well dish, multi-well reaction plate, microtiter plate, pipette plate, pipette dish, titer dish, tissue plate, culture plate, culture dish, or the like as is known and understood as a commonly employed term of art, refer to a surface used for experimental and/or laboratory purposes. These terms or the like as commonly employed as a term of art may be interchangeably be used with the context of this application and fall within the scope and meaning of the present invention.

Within the context of this application the term flowing fluid refers to any material in any state of matter that can readily flow for example including but not limited to a gas, air, fluid, liquid, plasma, mixture, colloid, gel, suspension.

A preferred embodiment of the present invention provides a device and system for maintaining and controlling the thermal environment surrounding an experimental plate.

Most preferably the device of the present invention comprises a piping network that surrounds and is most preferably configured to wrap and/or be wound about an experimental plate so as to optimize thermal coupling between the pipe network and experimental plate.

Optionally and preferably the device of the present invention comprises a piping network and plate holding member configured to surround and/or wrap an experimental plate so as to optimize thermal coupling between the pipe network and the experimental plate.

Optionally and preferably piping network according to the present invention may comprise at least one continuous pipe network circulating about an experimental plate.

Optionally pipe network according to the present invention may comprise at least one or more independent and continuous pipe networks circulating about an experimental plate.

Optionally pipe network according to the present invention may comprise two independent and continuous pipe networks circulating about an experimental plate. Optionally a first independent pipe networks may be provided to circulate a first flowing fluid about the experimental plate, while a second independent pipe network may be provided for circulating a second flowing fluid about the experimental plate.

Optionally the two independent pipe networks may be intertwined about the experimental plate.

An optional embodiment of the present invention provides a device for maintaining and controlling the environment surrounding an experimental plate providing for thermal control, minimizing evaporation and exposure to airborne contaminants the device comprising:

a plate holding member having a cavity for receiving and holding the experimental plate, providing for minimizing evaporation and exposure to airborne contaminants about the plate;

a continuous pipe network, defining a cavity for housing the plate holding member, wherein the pipe network surrounds the plate holding member about at least two surfaces and wherein the pipe network provides for circulating a temperature controlled flowing fluid about the at least two surfaces of the plate holding member, therein providing for thermal control about the plate and the plate holding member; the pipe network comprising an upper pipe network portion disposed over a first surface of the at least two surfaces and a lower pipe network portion disposed below a second surface of the at least two surfaces; and an external housing for encasing the pipe network; the external housing having at least one recess provided for gaining accessing to the plate holder cavity.

Optionally the external housing may comprise at least two recesses for gaining accessing to the plate holder cavity, and wherein the at least two recesses are disposed about opposite surfaces of the external housing, forming a continuous opening spanning the length of the device.

Optionally and most preferably each of the external housing, piping network, and plate holding member comprise a plate viewing recess configured to be aligned with one another most preferably defining a plate viewing window, provided for viewing and/or gaining access to at least a portion of the plate while the plate preferably associated with the plate holding member.

Optionally the pipe network further comprises short projections extending from the pipe network surface toward the pipe cavity and the plate holding member.

Optionally the pipe network further comprises a plurality of side pipe segment bridging the upper and lower pipe networks about the length of the pipe network therein circulating a flowing fluid about the perimeter of the plate holding member.

Optionally the pipe network may be configured to be essentially wound about the plate holding member.

Optionally the external housing may be provided from thermally insulating materials and wherein the pipe network and plate holding member are provided from thermally conductive material.

Optionally the external housing may be provided from a thermally insulating polymer selected from the group consisting of PVC, ABS, PP, PS, any combination thereof or the like.

Optionally the pipe network or plate holding member are provided from thermally conducting materials selected from the group consisting of metal, metal alloys, copper, aluminum and any combination thereof.

Optionally the device according to optional embodiments of the present invention may further comprise insulating materials provided for interfacing the pipe network and the internal surface of the external housing.

Optionally the plate viewing window may provide an auxiliary device with access to at least a portion of the plate while the plate is associated with the plate holding member. Optionally the auxiliary device may for example include but is not limited to a sampling robot, a pipette, an imaging device, a microscope, the like or any combination thereof.

Optionally the external housing may be configured and/or otherwise adapted to associate or otherwise couple to an auxiliary device.

Optionally the auxiliary device may for example include but is not limited to a sampling robot, robotic arm, a pipette, an imaging device, a microscope, syringe, piston operated syringe or any combination thereof.

Optionally the device according to an optional embodiment of the present invention may further comprise a cover that may be disposed over a working/viewing window to cover the viewing window. Optionally the cover may provide selective access to a portion of the plate, for example a particular column of the plate. Optionally the window and/or cover may provides access to individual cells and/or wells within the viewing window.

An optional embodiment of the present invention provides for a system for maintaining and controlling the environment surrounding an experimental plate providing for thermal control, minimizing evaporation and exposure to airborne contaminants, the system comprising a plate holding device according to optional embodiment of the present invention, wherein the pipe network may be associated with a fluid pump for circulating a flowing fluid through the pipe network wherein the flowing fluid may be pumped from a temperature controllable reservoir with the fluid pump.

Optionally the system may further comprise an auxiliary device for accessing and obtaining a sample from at least a portion of the plate through a viewing window. Optionally the auxiliary device may for example include but is not limited to a sampling robot, robotic arm, a pipette, an imaging device, a microscope, syringe, piston operated syringe, any combination thereof, or the like.

Optionally plate holding member and pipe network may be provided as a single unit.

Optionally plate holding member may comprise a guide for example including but not limited to rail, guide rail, track, track guide or the like, for example in the form of a drawer guide, for example for receiving and or associating with an experimental plate.

Optionally the plate holding member may be realized in the form of a guide for example including but not limited to rail, guide rail, track, track guide or the like, for example in the form of a drawer guide, for example for receiving and or associating with an experimental plate. Optionally drawer guide may be directly coupled and/or otherwise associated with the pipe network.

Unless otherwise defined, all technical and scientific terms used herein have the same meaning as commonly understood or employed as a term of art by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 7A-C are varying views of a schematic illustrative diagram of an optional pipe network according to an optional embodiment of the present invention, utilized with an exemplary device of the present invention, according to an optional embodiment of the present invention;

DESCRIPTION OF THE PREFERRED EMBODIMENTS

Figure 1A:
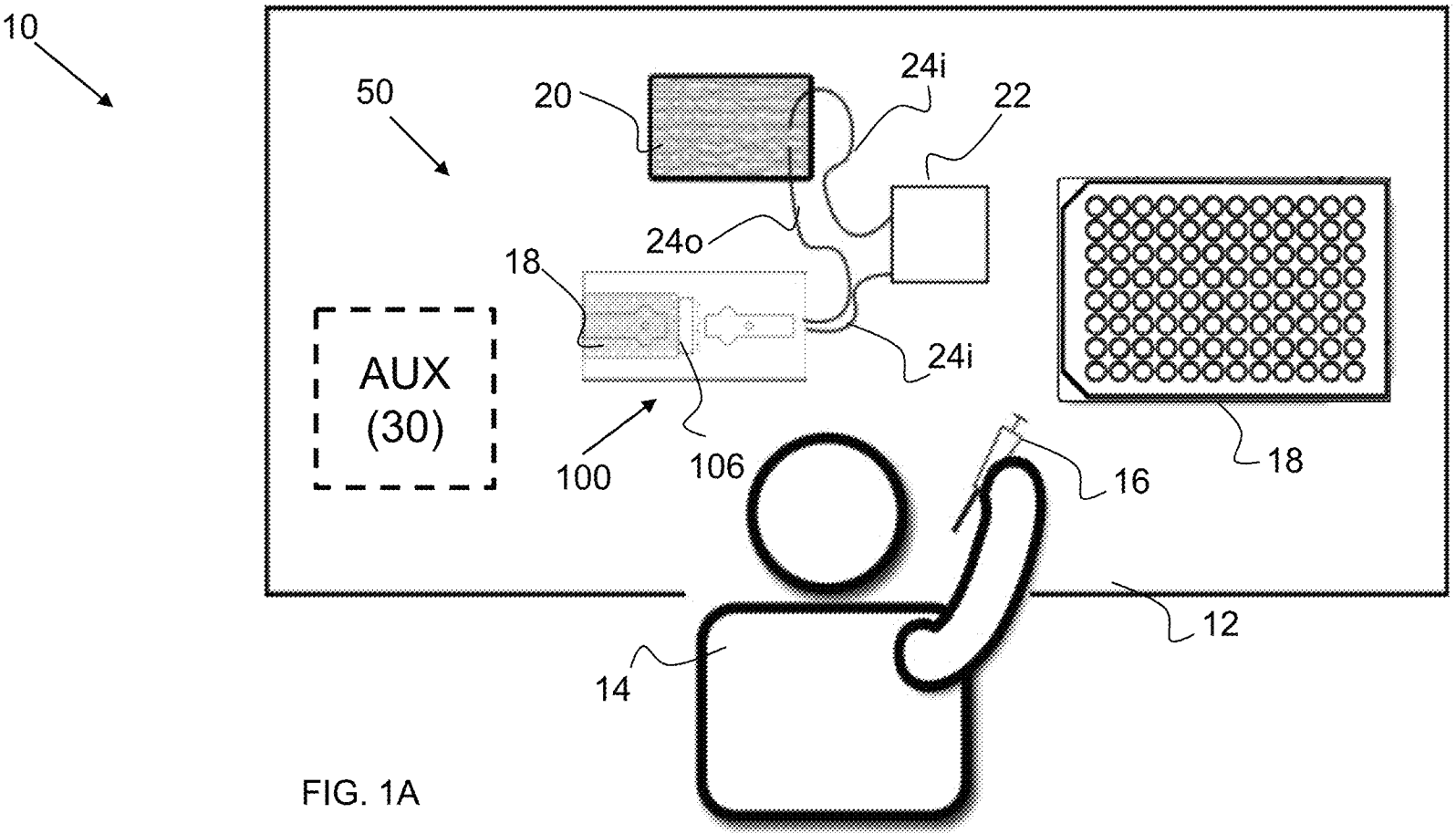
FIG. 1A is a schematic block diagram of an exemplary device and system according to an optional embodiment of the present invention.

The principles and operation of the present invention may be better understood with reference to the drawings and the accompanying description. The following figure reference labels are used throughout the description to refer to similarly functioning components are used throughout the specification hereinbelow.

10 work bench laboratory setting;
12 work station;
14 user
16 pipette;
18 pipette well plate;
20 water bath temperature control unit;
22 fluid pump;
24 pump tubing piping
24*o* outlet piping network;
24*i* inlet piping network;
30 Auxiliary device;
50 system
100 plate holder;
101 plate holder housing;
102 second end;
102*r* second end recess;
104 first end;
104*r* first end recess/opening;
106 plate viewing and working window;
106*c* hinged window cover;
106*h* well window moving handle;
106L well cover/lid;
106*r* well window recess/opening;
106*s* well window solid portion;
106*w* well window cover;
108L lower portion recess handle;
108*u* upper portion recess handle;
110 upper housing;
110*r* upper housing recess;
110*p* upper housing pipe fitting recess;
112 second member sliding tool recess;
112*s* second member sliding tool;
114 first member sliding tool recess.
114*s* first member slide tool;
114*h* sliding tool handle;
114*o* first member opening;
116 upper housing plate viewing recess;
118 sliding tool assembly
120 lower housing;
120*r* lower housing recess;
120*p* lower housing pipe fitting recess;
122 pipe inlet/outlet recess;
130 pipe network;
130*b* pipe bridge segment;
130*c* pipe network cavity;
130*s* pipe support member;
130*u* upper pipe network;
130L lower pipe network;
130*p* perimeter circulating pipe network
132 lower pipe network opening;
132*c* lower pipe inlet/outlet coupler
134 upper pipe network opening;
134*c* lower pipe inlet/outlet coupler
136 pipe network plate viewing recess;
138 pipe projection;
140 plate holding/covering/sealing member;
140*c* plate holder cavity;
140*h* plate holder height surface;
140L plate holder lower surface;
140*u* plate holder upper surface;
140*o* plate holder open end;
142 holding member second end;
144 holding member first end;

146 plate holder plate viewing recess;

FIG. 1A shows is a system 50 according to an optional embodiment of the present invention the system comprising a thermo-conductive reaction plate holder 100 for controlling the temperature about a reaction plate 18 associated with plate holder 100. Most preferably system 50 control the temperature within plate holder 100 about plate 18 by circulation a flowing fluid, through pipe network 130 (not shown see FIGS. 6-8, 10). Most preferably a fluid pump 22, optionally provided in form of a peristaltic pump as shown, is utilized for pumping a temperature controlled flowing fluid from a fluid reservoir 20 through pump tubing piping 24.

Optionally and most preferably reservoir 20 comprises a temperature controlled flowing fluid, for example including but limited to water, gas, cryogenic fluid or the like temperature controllable fluid or gas. Optionally and preferably reservoir 20 comprise intrinsic temperature control module (not shown) comprising electronics, user-interface and appropriate sensors to maintain and control the temperature of a flowing fluid stored within reservoir 20.

Most preferably a temperature controlled flowing fluid is circulated from the reservoir 20 to fluid pump 22 to plate holder 100 and then back to reservoir 20. Most preferably, a flowing fluid is circulated via network 24 consisting of inlet piping network 24*i* from reservoir 20 toward pump 22 and then entering plate holder 100 wherein inlet piping network 24*i* is coupled with pipe network 130 disposed within plate holder 100. After circulating through pipe network 130, flowing fluid exits pipe network 130 toward outlet pipe 24*o* provided for pumping flowing fluid from plate holder 100 back to reservoir 20, wherein the flowing fluid may be tempered as needed.

Optionally pipe network 24 and pipe 130 are coupled through an appropriate coupler via either lower pipe network opening 132 or 134 upper pipe network opening. Optionally and most preferably pipe network 24 and pipe network 130 are coupled via a dedicated coupler 132*c* and/or 134*c* (FIG. 6, 10) disposed about lower pipe network opening 132 and/or 134 upper pipe network opening, respectively.

Optionally system 50 may be further utilized with an optional auxiliary device 30, for example including but not limited to a sampling robot, robotic arm, a pipette, an imaging device, a microscope, syringe, piston operated syringe, the like or any combination thereof.

FIG. 1A further shows optional implementation of the present invention with a laboratory setting 10 about a lab work station 12. For example, a user 14 carrying out a biochemical reaction, utilizes pipette 16 to properly load and/or dispense reagents within the wells of a titer plate 18. Following dispensing a reagents about at least one or more well disposed on titer plate 18, plate 18 is associated with plate holder 100 for example for flash cooling, as will be described in greater details depicted in FIG. 10.

Optionally once plate 18 is loaded onto holder 100 at least a portion of plate 18 may be accessed and/or view through a viewing and/or working window 106. Optionally window 106 may be utilized to gain access to a loaded plate 18, optionally by employing an auxiliary device 30. Auxiliary device 30 may for example include but is not limited to sampling robot, robotic arm, a pipette, an imaging device, a microscope, syringe, piston operated syringe, the like or any combination thereof.

Optionally plate holder 100 may be associated or otherwise coupled with an auxiliary device 30. For example plate holder housing 101 may be coupled with an optional auxiliary device 30, for example including but not limited to a sampling robot, so as to approximate access to at least a portion of plate 18 associated with plate holder 100, allowing sampling robot to sample an analyte from least one reaction well disposed on plate 18 while associated with plate holder 100, for example through window 106.

Most preferably system 50 utilizing plate holder 100 may be placed and utilized about a laboratory setting 10 on work station 12 not requiring a dedicated space and/or set up therefore seamlessly utilized within most laboratory settings 10, while offering an inexpensive manner for maintaining plate 18 about a controllable temperature.

Figure 1B:
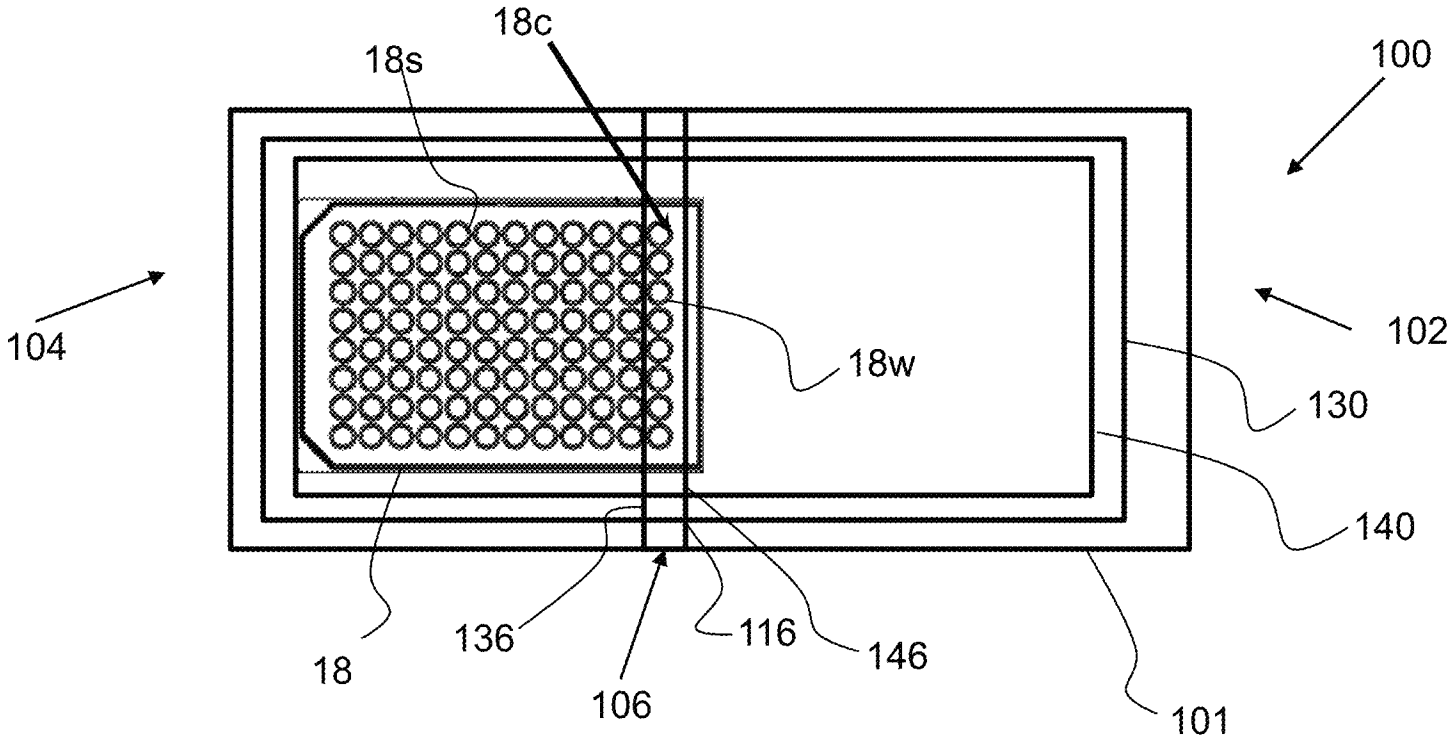
FIG. 1B is a schematic block diagram of an exemplary device according to an optional embodiment of the present invention.

FIG. 1B shows a schematic block diagram of device 100 according to an optional embodiment of the present invention. Most preferably device 100 provides for controlling the environment surrounding an experimental plate 18 and in particular to essentially seal experimental plate 18 within a temperature controllable housing 101, therein most preferably preventing unwanted interactions with potential airborne contaminants, while maintaining experimental plate 18 at a controllable temperature, environment, and minimizing any evaporation from reaction plate 18. Airborne contaminants may for example include but is not limited to air, gasses, vapor, aerosols, moisture, dust, or the like.

Device 100 most preferably provides for sealing at least a portion the majority of experimental plate 18 from potential airborne contaminants, while providing a working window 106, so as to ensure the integrity of the experimental plate 18 while a user 14 performs steps of an experiment, such as utilizing pipette 16 to loading experimental plate 18 with reagents and/or analyte as required by an experimental protocol.

Device 100 is most preferably provides a controllable environment for and about experimental plate 18 by utilizing an enveloping and/or encasing and/or surrounding configuration about plate 18. Device 100 is most preferably configured to be centered about plate 18 therein arranged to envelope and/or encase and/or surround and/or essentially seal experimental plate 18 during use.

Most preferably device 100 comprises a housing 101, pipe network 130 and plate holding member 140. Most preferably each of housing 101, pipe network 130 and plate holding member 140 comprise a corresponding recess that most preferably align with and over one another to provided for forming working and/viewing window 106. Most preferably housing 101 is provided plate working/viewing recess 116; pipe network 130 is provide with a corresponding pipe network working/viewing recess 136; plate holding member 140 is provide with a corresponding working/viewing recess 146. Most preferably recesses 146, 136, 116 are collectively aligned to form working and/or viewing window 106.

Optionally, device 100 has a substantially rectangular shape that may optionally be configured to receive and associate with most multi-well reaction plates 18, generally provided in a 12 by 8 matrix. However plate holder 101 and housing 101 are not limited to such a rectangular shape. Optionally plate holder 100 may be configured to have any size and shape capable and adapted to fit any form, size or shape of optional reaction plate 18.

Most preferably device 100 is configured to receive plate 18 through at least one or more openings disposed about housing 101 most preferably disposed on a first end 104 and second end 102. Most preferably plate 18 may be advanced through the length of device 100 defined between first end 104 and second end 102. Optionally plate 18 may be loaded and/or otherwise associated with device 100 through holding member 140 via an opening and/or recess 104*r*, 102*r* (see FIGS. 2, 3, 5), disposed at either first end 104 or second end 102.

Optionally and preferably device 100 is provided with a length that is at least twice as long as the length of reaction plate 18, most preferably to allow a user to advance plate 18 about the length of device 100, between first end 104 and second end 102. Most preferably plate 18 may be sequentially advanced between first end 104 and second end 102, over window 106 therein gradually providing access to a limited portions of plate 18, for example a single column 18*c*, that disposed over window 106, as a user 14 loads individual wells 18*w* disposed about plate column 18*c*, while the remaining wells 18*s* remain sealed and thermally controlled within holding member 140. Optionally, plate 18 may be stored and/or maintained within plate holder 100 for an unlimited period of time. Optionally and preferably plate 18 may be associated within holding member cavity 140*c* of device 100 for an unlimited time, most preferably while maintaining plate 18 under controllable conditions. Most preferably such controllable conditions may for example include but are not limited to, preventing unwanted interactions with potential airborne contaminants, maintaining experimental plate 18 at a controllable temperature, and minimizing any evaporation from reaction plate 18, for example.

Optionally and preferably plate 18 may be maintained in such controllable conditions within device 100 for extended periods of time. Optionally plate 18 may be placed within the cavity of device 100 such that it is not adjacent to any opening disposed about device 101, for example including but not limited to open ends 102,104, 142, 144 and/or window 106.

Figure 1C:
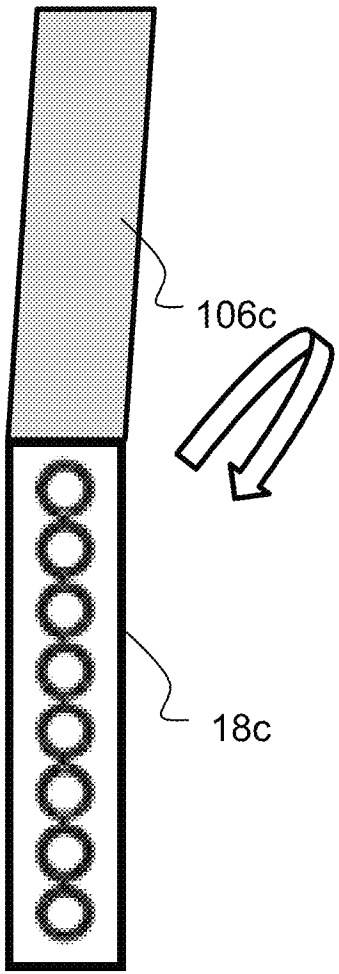
FIG. 1C-E show a schematic block diagram of an optional viewing and/or working window cover for associating with an exemplary device according to an optional embodiment of the present invention.
Figure 1E:
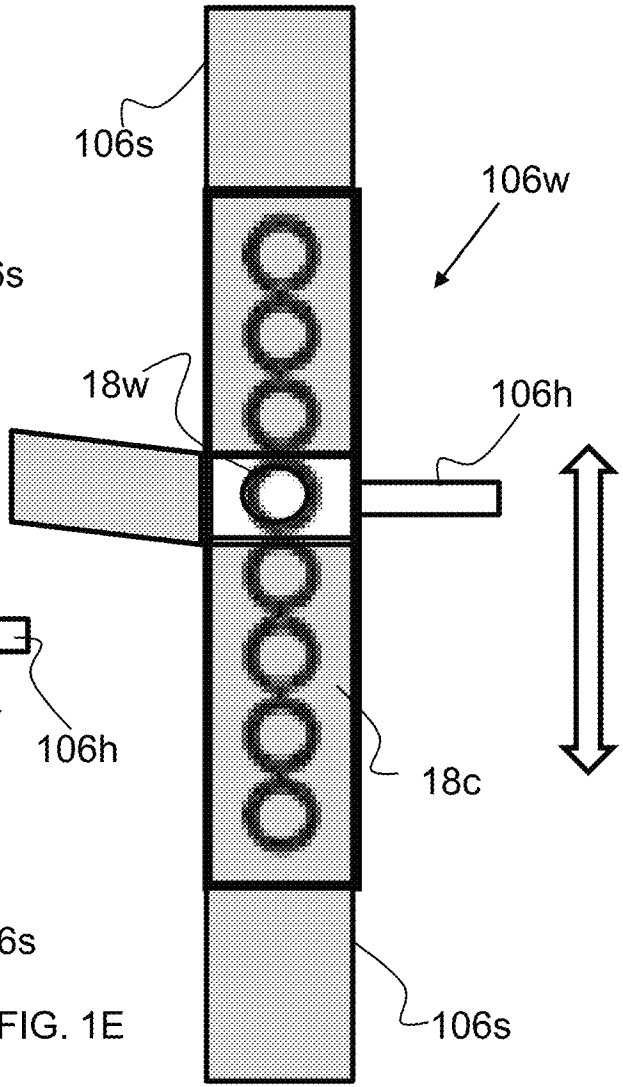
Figure 1D:
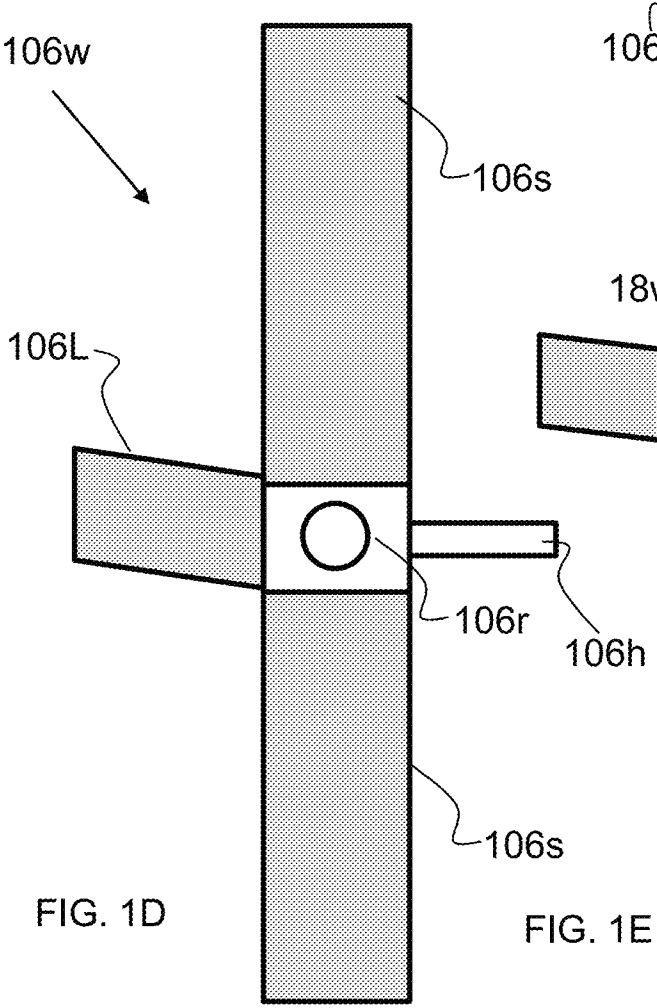

Optionally device 100 may be sealed while a plate 18 is disposed therein by placing optional covers over an external opening for example including but not limited to window 106, first end 104, and second end 102 therein most preferably sealing device 100. Optionally window 106 may be covered with an optional window cover 106*c*,106*w* (FIG. 1C-E). Optionally first end 104, and/or second end 102 may be sealed and or closed with an optional cover (not shown) disposed over the respective opening about housing 101,110.

FIG. 1C shows a schematic block diagram illustrating an optional window cover 106*c* optionally provided to cover window 106 when window 106 is not in use and to allow access to plate column 18*c* as necessary. Optionally window cover 106*c* may be hinged with window recess 116 disposed about housing 101 and fits over window 106, therein providing for further evaporation control while maintaining temperature control within device 100. Window cover 106*c* most preferably provides for opening and closing access to a portion of plate 18, for example, column 18*c* as previously described, as illustrated by the curved directional arrow.

Optionally window cover 106*c* is provided from clear and/or see-through thermally insulating materials.

FIGS. 1D-E show a schematic block diagram illustrating an optional well-window cover 106*w* optionally providing to fully close and/or cover window 106 while not in use and during use provides a well-specific access point to individual wells 18*w*, within plate 18 and in particular in well column 18*c* disposed within window 106, as shown in FIG. 1E. FIG. 1D provides a perspective view of an optional cover 106*w* without plate 18.

Optionally window cover 106*w* may associated with window recess 116 disposed about housing 101 to fit over window 106, and configured to move about the length of window 106, optionally with a rail or longitudinal recess. Most preferably window cover 106*w* provides further evaporation control while maintaining temperature control within device 100, as only individual wells are exposed to the elements as they are being loaded, while all remaining wells are covered therein maintaining evaporation control about individual wells 18*w* within plate 18.

Well-window cover 106*w* optionally and preferably comprises a cover moving handle 106*h* provided to manipulate cover 106*w* about the length of window 106 and recess 116, as shown by the up and down directional arrow. Window cover 106*w* comprises an opening and/or recess 106*r* corresponding to an individual well 18*w*. Optionally well window recess 106 is optionally disposed about the midway of the length of cover 106*w*. Optionally well-window cover 106*w* may further comprise a lid and/or cover specific to fit over recess 106*r* therein providing for fully covering and/or closing window 106, for example utilized when not loading plate 18. Optionally the length of window cover 106*w* is configured such that only a single well may be opened at a time, while a first well 18*w* is loaded with an analyte for example, the remaining wells in particular the wells falling within column 18*c* remain covered with solid cover portion 106*s*.

Optionally and preferably window cover 106*w* is provided from clear and/or see-through thermally insulating materials.

FIGS. 2A-E show varying close up views of plate holder 100 according to a preferred embodiment of the present invention.

Figure 2B:
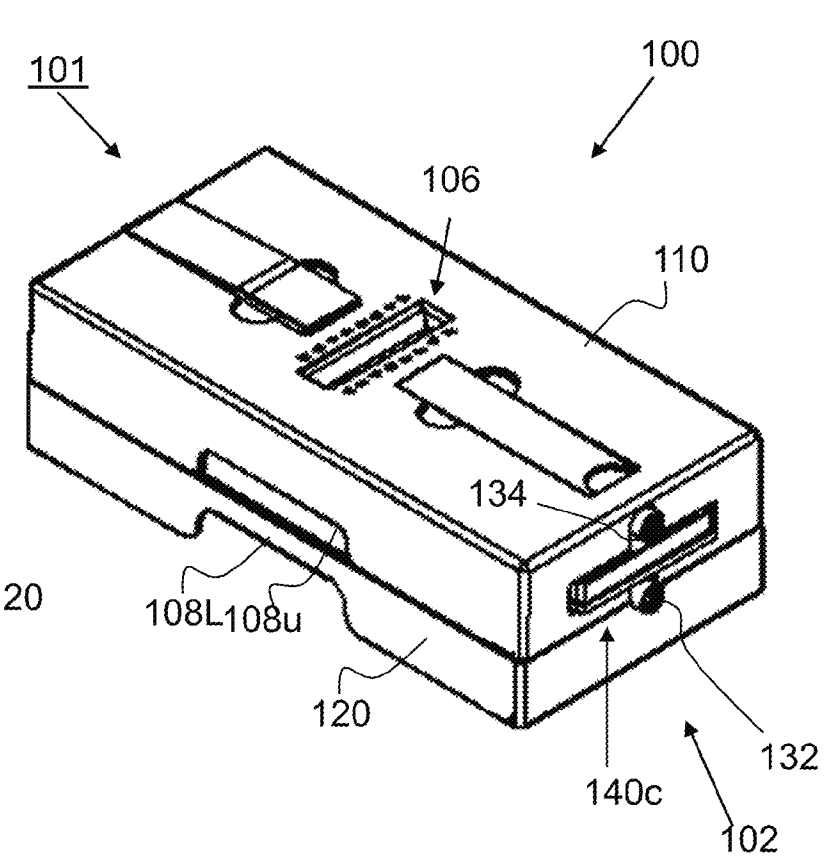
FIG. 2A-E are varying views of a schematic illustrative diagrams of an exemplary device according to an optional embodiment of the present invention.
Figure 2A:
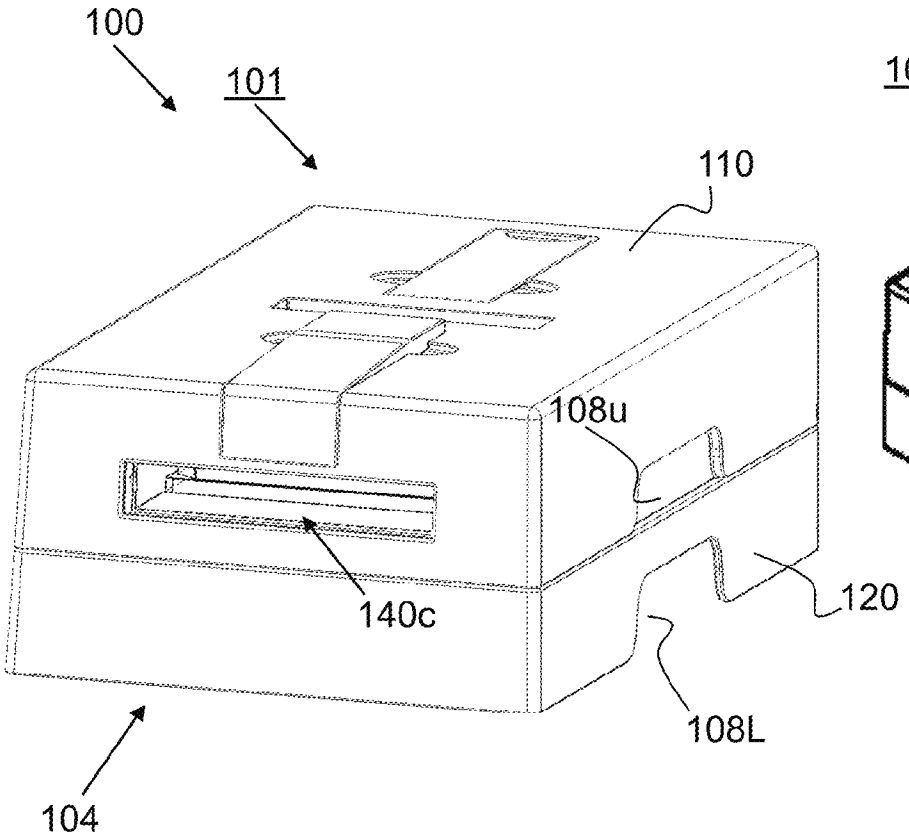

FIGS. 2A-B show perspective views of plate holder 100 comprising housing 101 most preferably comprising upper housing member 110 and a lower housing member 120. Plate holder 100 having a substantially rectangular shape, as shown, may optionally be configured to receive and associate with most multi-well reaction plate 18, generally provided in a rectangular shape having 12×8 configuration. However plate holder 101 and housing 101 are not limited to such a rectangular shape. Optionally plate holder 100 may be configured to have any size and shape capable and adapted to fit any form, size or shape of a reaction plate requiring temperature control that surrounds the reaction plate about at least two surfaced and optionally about two or more surfaces.

FIG. 2A shows a first end 104 of plate holder 100 wherein upper housing 110 comprises a recess 104*r* for receiving a reaction plate 18 providing access toward the internal plate holder cavity 140*c*. FIG. 2B shows a second end 102 of upper housing 110 comprising a recess 102*r* for receiving a reaction plate 18. Most preferably plate holder cavity 140*c* is continuous about the length of holder 100 between first end 104 and second end 102.

Optionally and most preferably recess 102*r* provides an opening both for receiving a reaction plate 18 and forming an inlet/out 132, 134 for fitting and coupling with pipe network 130 with pump pipe network 24.

Plate holder 100 optionally and preferably comprises a carrying recess 108*u*, 108L, distributed about upper housing 110 and lower housing 120, as shown.

Optionally and most preferably upper housing 110 comprises a recess 116 defining the upper end of a window 106 most preferably providing view and/or access to a least a portion of reaction plate 18 within the window recess and disposed within holder 100 about cavity 140*c*.

Optionally housing 101 about at least one or both of upper housing 110 or lower housing 120 may be further adapted to provide for coupling and or otherwise associating with an optional auxiliary device 30, not shown.

Figure 2E:
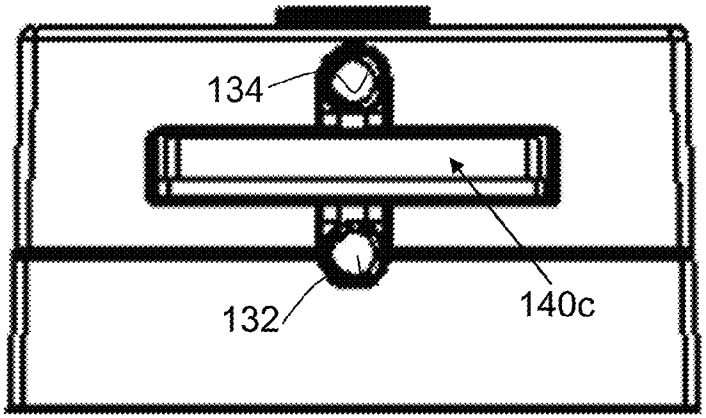
Figure 2D:
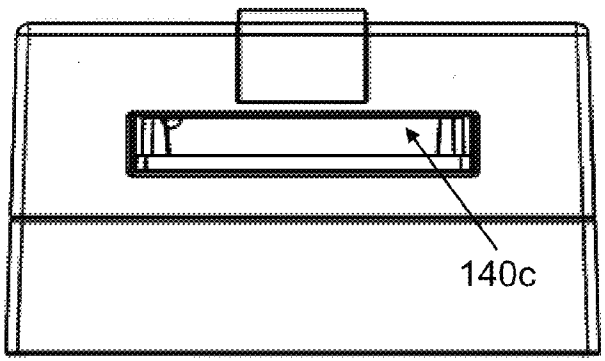
Figure 2C:
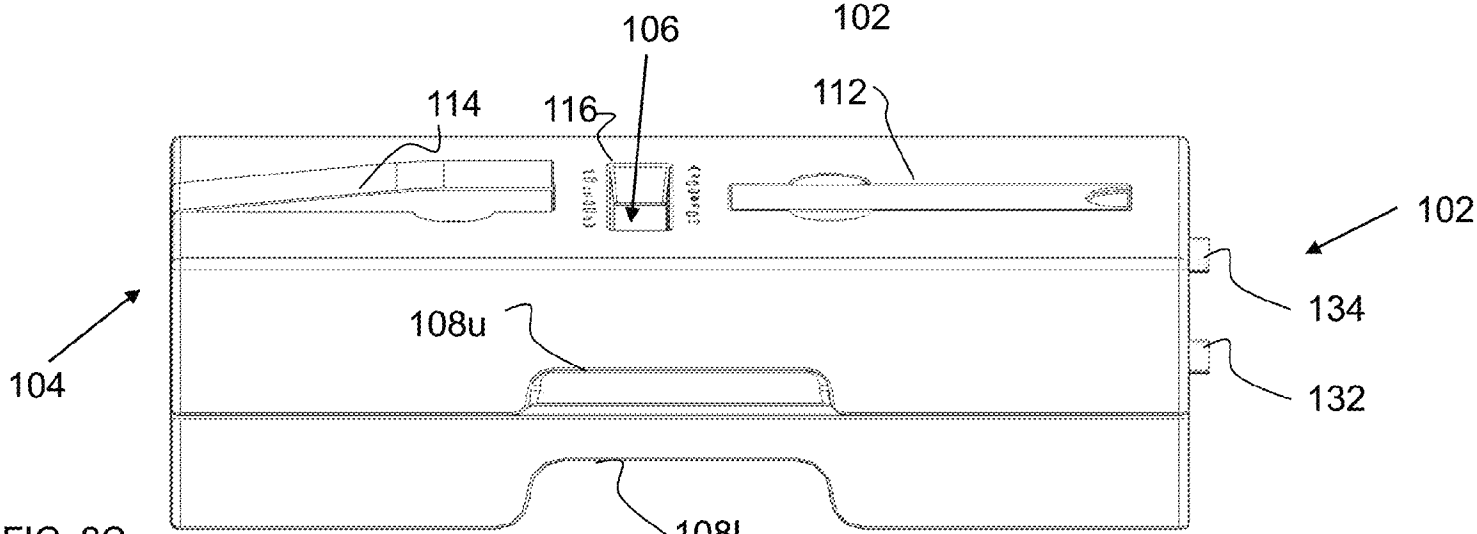

FIG. 2C shows a face on side view of holder 100, therein providing a closer depiction of upper housing carrying recess 108*u* and lower housing to carrying recess 108L. FIG. 2C further shows a profile of second end 102 showing a view of pipe inlet/outlet 132, 134.

FIG. 2D shows a face on side view of first end 104 providing a further depiction of plate holding member cavity 140*c* and recess 104*r*.

FIG. 2E shows a face on side view of second end 102 providing a further depiction of recess 102*r* providing for an opening for plate holding member cavity 140*c*, and pipe network 130 about inlet/outlet 132 and 134.

Figure 3:
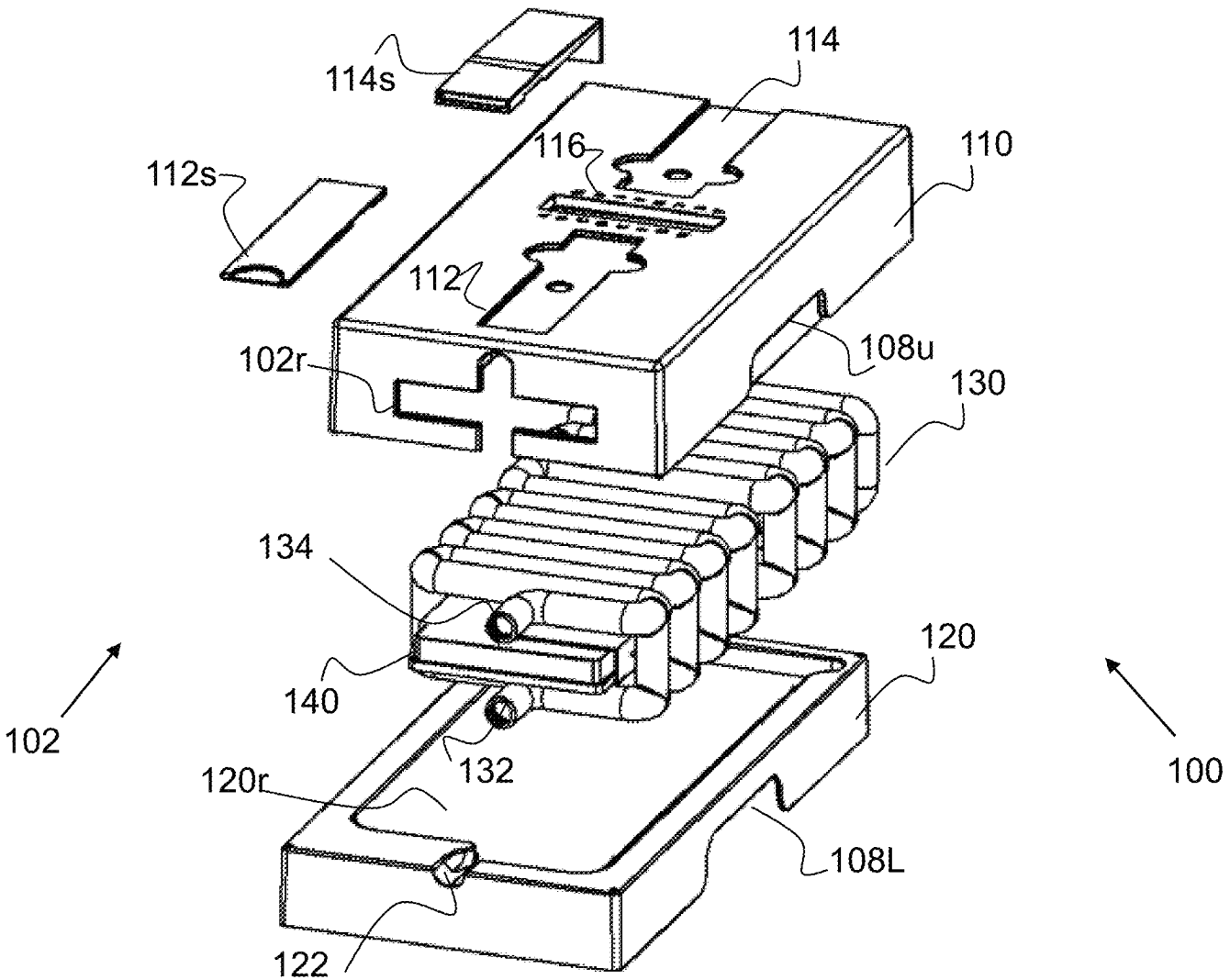
FIG. 3 is an exploded view of a schematic illustrative diagram of an exemplary device according to an optional embodiment of the present invention.

FIG. 3 provides a perspective exploded view of plate holder 100 about second end 102 providing a close depiction of the various components that may comprise thermo-conductive reaction plate holder 100 according to an optional embodiment of the present invention. Most preferably, plate holder 100 comprises lower housing 120, pipe network 130, experimental plate receiving member 140 and upper housing 110, as shown.

FIG. 3 shows an optional and preferred embodiment of the present invention for a thermo-conductive reaction plate holder 100 including a pipe network 130 that is configured to surround a reaction plate 18 about at least two surfaces most preferably its two largest surfaces for example a lower surface and an upper surface. Most preferably holder 100 encases a reaction plate 18 in an internal plate holding member cavity 140*c* therein providing for a thermally controlled environment surround reaction plate 18, having a controllable core temperature. Most preferably thermal control is provided by circulating a flowing fluid through pipe network 130 disposed about at least two surfaces. Optionally, as will be shown in FIG. 8, an optional pipe network 130 may be provided to fully surround experimental plate 18 and may be wound about plate 18 to provide temperature control about more than two surfaces.

Most preferably the core temperature about plate holder 100 is controlled and determined by the flowing fluid circulation within pipe network 130 surrounding plate 18.

Most preferably plate 18 is received and associated with plate holding member 140 about cavity 140*c*. Most preferably plate holding member 140, described in further detail in FIG. 9, is disposed internally to pipe network 130 within pipe network cavity 130*c*. Most preferably pipe network 130 surrounds and encases holding member 140 most preferably to maintain and control core temperature of plate holder 100.

Optionally plate 18 may be placed and/or loaded onto holding member 140 by a user 14. Optionally placing plate 18 within holding member cavity 140*c* may require the use of a sliding tool 118 to displace plate 18 from one end, for example first end 104, to the opposite end, for example second end 102.

Optionally sliding tool assembly 118 depicted in more detail in FIG. 4, may be stored about at least one or more dedicated recess 112, 114 disposed on housing 101, most preferably about upper housing 110 as shown. Most preferably recess 112 and 114 are provided for storage and of sliding tool components, as shown. Most preferably sliding tool assembly 118 may be composed from at least two members, a first member 114*s* and a second member 112*s*. Most preferably second member 112*s* is fit within an opening 114*o* about first member 114 to form assembly 118.

Figure 4A:
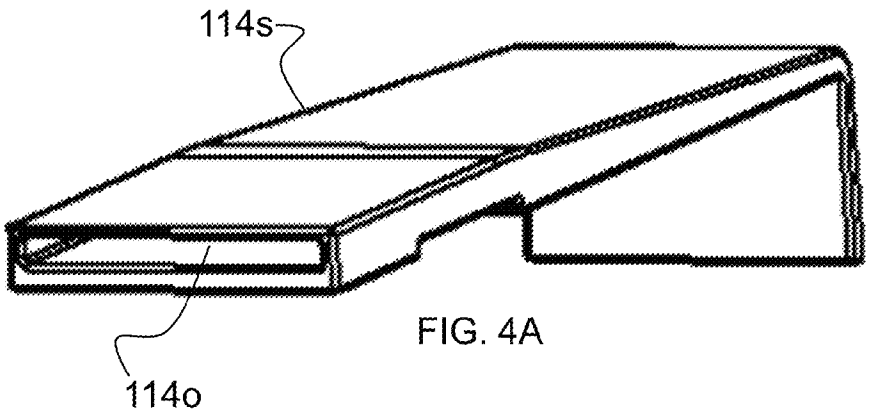
FIG. 4A-F are varying views of a schematic illustrative diagrams of an exemplary sliding tool assembly utilized as an adjunct tool with the device according to an optional embodiment of the present invention.
Figure 4B:
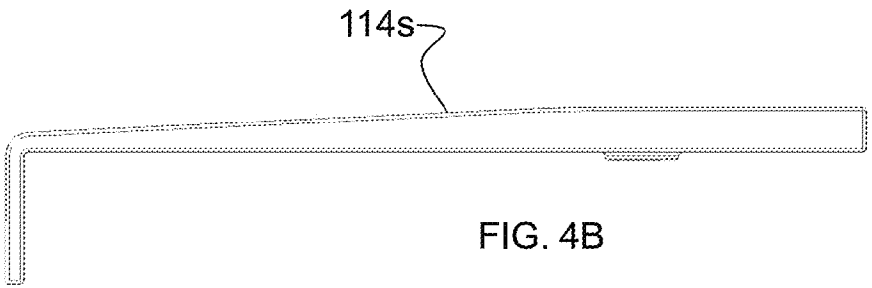

FIG. 4A shows a perceptive view of first sliding member 114*s* while FIG. 4B shows a side view of first member 114*s*.

Figure 4C:
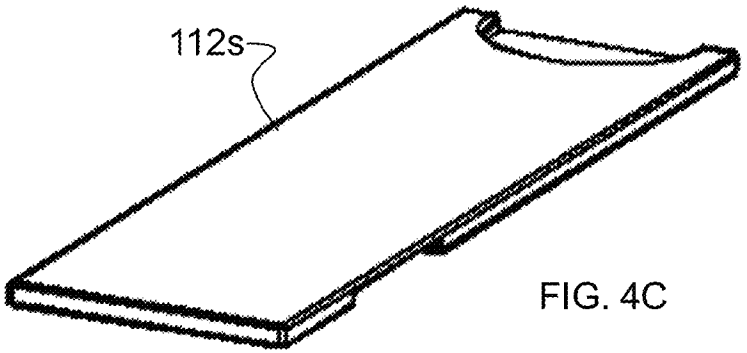
Figure 4D:
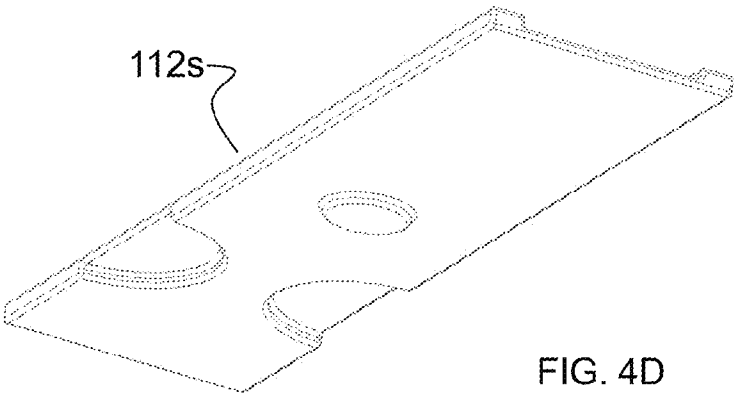

FIG. 4C shows a perceptive view of second sliding member 112*s* while FIG. 4D shows a bottom up perspective view of second member 112*s*.

Figure 4E:
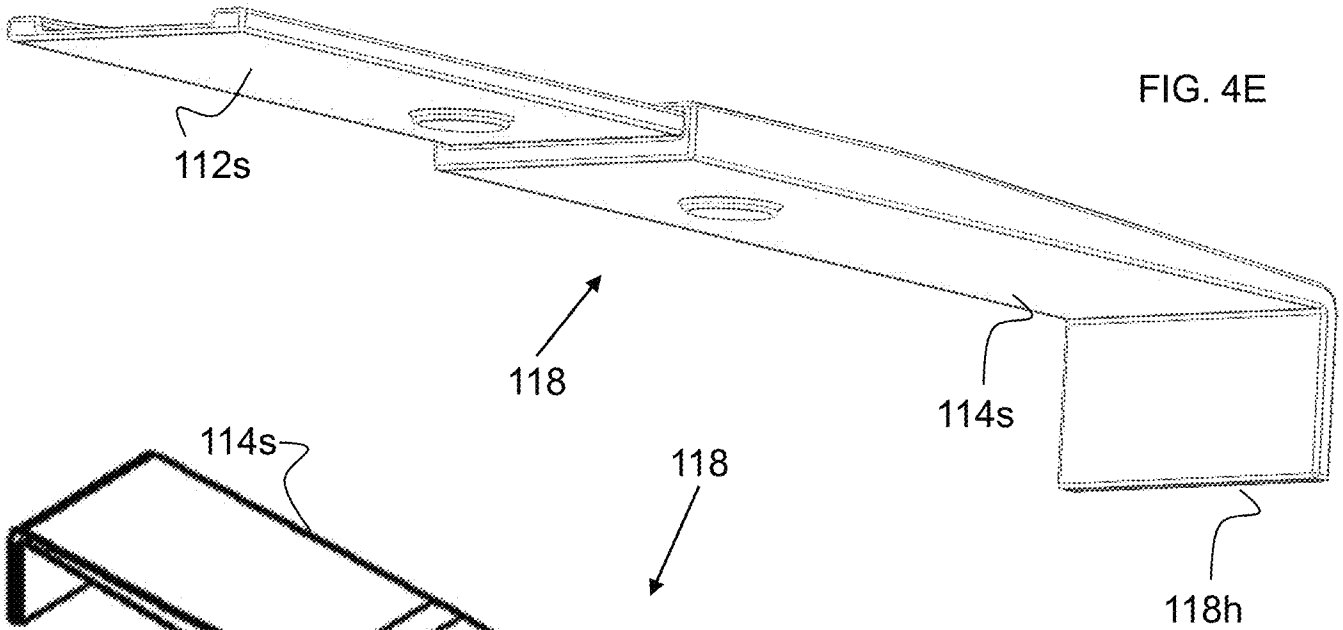
Figure 4F:
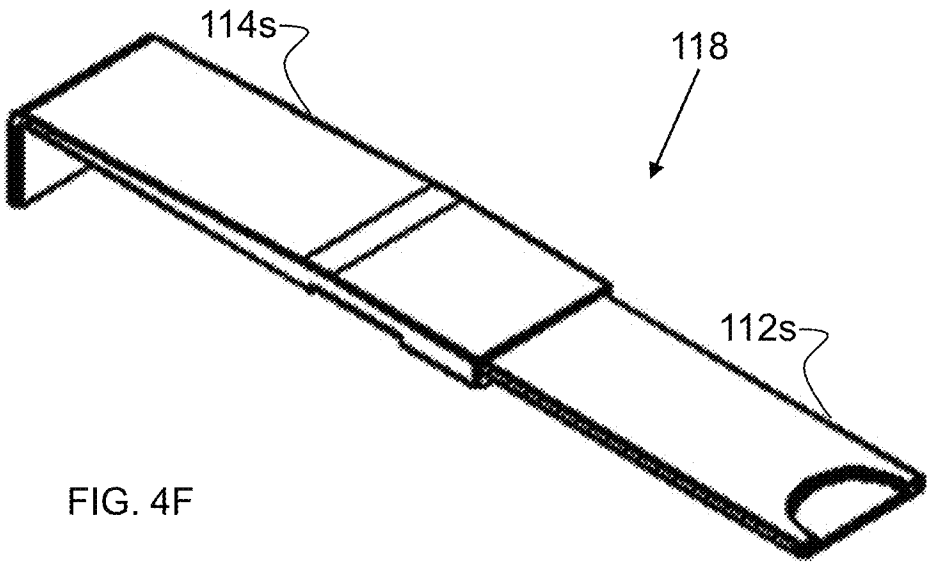

FIG. 4E and FIG. 4F show two perspective views of sliding tool assembly 118 formed by coupling second member 112*s* with first member 114*s* about opening 114*o* forming tool 118 that may be manipulated with handle 114*h* to maneuver plate 18 about plate holder 100.

Figure 5C:
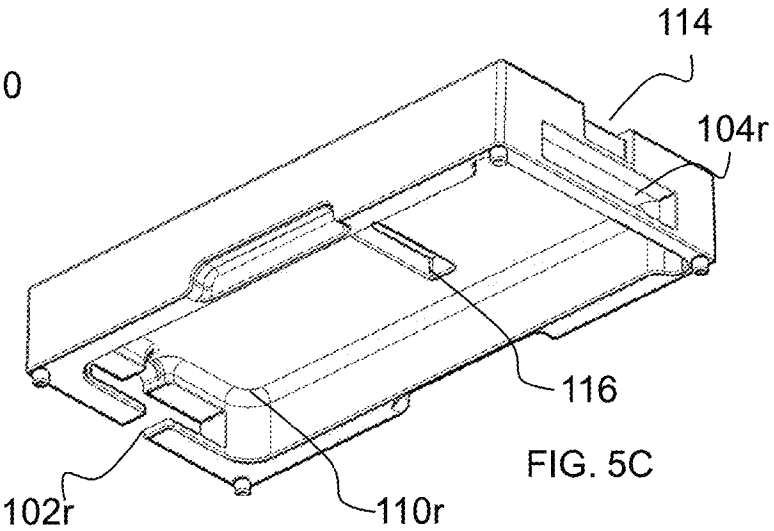
FIG. 5A-D are varying views of a schematic illustrative diagrams of an upper housing of an exemplary device according to an optional embodiment of the present invention.
Figure 5D:
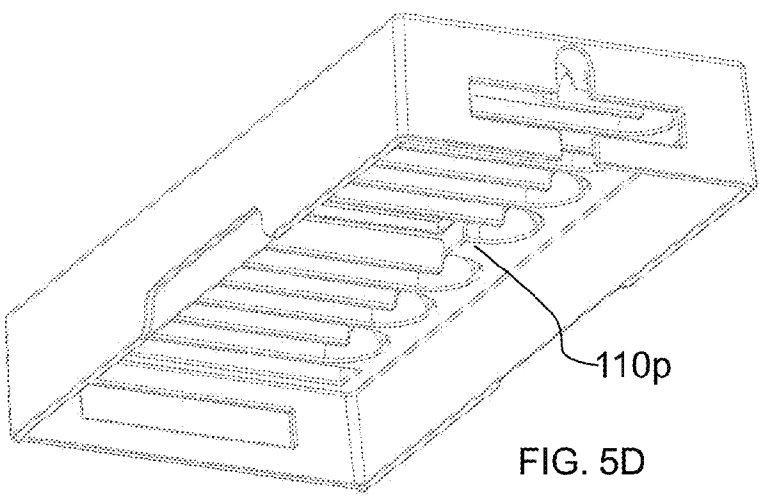
Figure 5A:
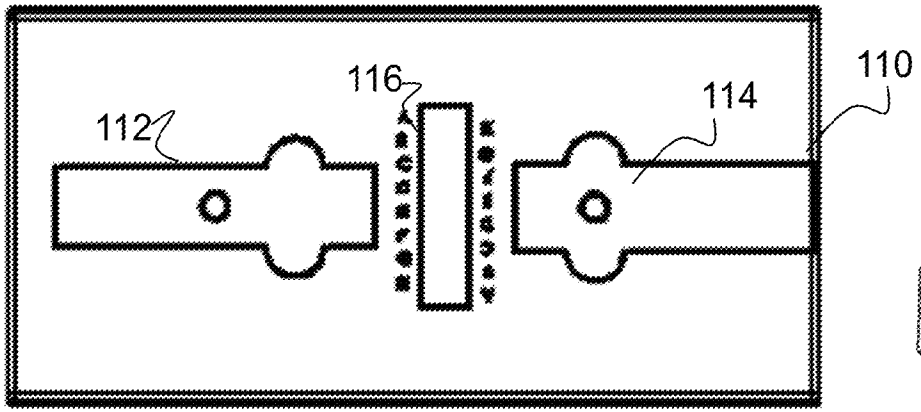

FIGS. 5A-D show varying views of upper housing member 110 most preferably provided from thermally insulating materials, for example including but not limited to a polymer, plastic, PVC, ABS, PP, PS, any combination thereof or the like. FIG. 5A shows a face on view of the external surface of upper housing member 110. FIG. 5A shows sliding tool recesses 112, 114 respectively disposed about the external surface of housing member 110. Housing member 110 further shows upper housing plate viewing recess 116 with optional markings corresponding to marking of plate 18. Most preferably viewing recess 116 defines the upper end of a window 106 most preferably providing view and/or access to a least a portion of reaction plate 18 that is disposed within the window frame and disposed within holder 100 about cavity 140*c*.

Figure 5B:
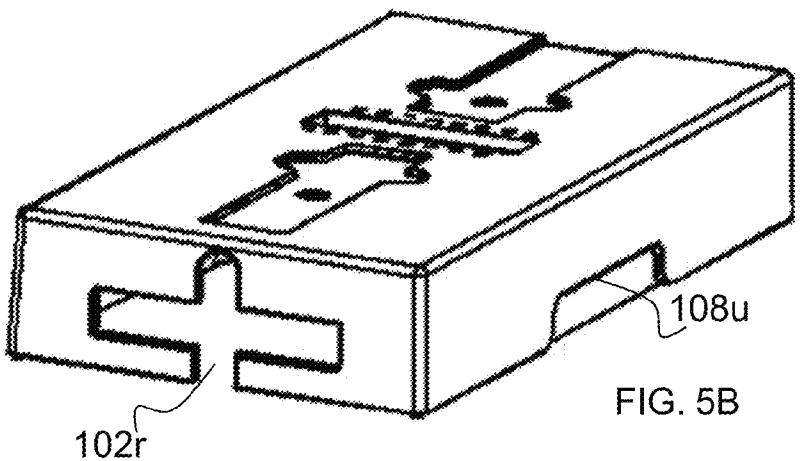

FIG. 5B shows a perspective view of housing 110 about second end 102 showing recess 102*r* and optional upper handle recess 108*u* as previously described.

FIGS. 5C-D showing the internal surface of housing 110. FIG. 5C depicts the internal surface about first end 104 showing recess 104*r* and first member sliding tool recess 114 about handle portion 114*h*. FIG. 5D depicts the internal surface about second end 102 showing recess 102.

FIG. 5C further shows a preferable and optional lower housing 110 configuration about the internal surface of housing 110, comprising upper housing recess 110*r* outlined for receiving and/or associating with pipe network 130 about upper pipe network 130*u*.

FIG. 5D further shows an optional lower housing 110 configuration about the internal surface of housing 110, comprising upper housing pipe fitting recess 110*p* outlined for receiving and/or associating with pipe network 130 about upper pipe network 130*u*. Most preferably recess 110*p* is provided in a one to one configuration fitting exactly with upper pipe network 130*u*, wherein upper housing 100 is molded to fit with upper pipe network 130*u* about recess 110*p*.

Optionally upper housing 110 may comprise insulating material fit about its internal surface, disposed between recess 110*r*,110*p* and upper pipe network 130*u*, optionally provided to further insulate and maintain the core temperature within plate holder 100.

Now referring collectively to FIGS. 6-8 show optional embodiments and configurations for pipe network 130, 130*p* according to the present invention provided for circulating a temperature controlled flowing fluid about plate holding member 140. Pipe network 130, 130*p* is most preferably a continuous pipe network comprising an upper pipe network portion 130*u* and a lower pipe network 130L. Most preferably pipe network 130 defines a cavity 130*c* for housing plate holding member 140 (shown in FIG. 10).

Pipe network 130 most preferably surrounds plate holding member 140 configured such that holding member 140 is sandwiched within the continuous pipe network 130,130*p* at least two surfaces. Optionally and preferably upper pipe network portion 130*u* may be disposed over a first surface holding member 140 while lower pipe network portion 130L may be disposed over a second surface of holding member 140.

Most preferably upper pipe network portion 130*u* and lower pipe network portion 130L are continuous with one another with at least one pipe bridging segment 130*b*.

Optionally and preferably pipe network cavity 130*c* is maintained between upper portion 130*u* and lower portion 130L with support members 130*s*.

Most preferably pipe network 130,130*p* comprise a pipe network plate viewing recess 136 defining a gap within piping network 130 to provide for defining viewing window 106.

Most preferably viewing recess 136 is aligned with housing recess 116 so as to provided for forming window 106. Most preferably recess 136 is disposed about at least upper pipe network 130*u*. Optionally window recess 136 may be disposed about both upper pipe network 130*u* and lower pipe network 130L.

Most preferably pipe network 130 is configured to optimize thermal conduction toward the center of holder 100 where plate 18 is disposed. Most preferably pipe network 130 is optimized surface area coverage about at least the upper and lower surfaces of holding member 140 therein extending the pipe network over the surfaces of holding member 140.

Pipe network 130,130*p* optionally and most preferably define a continuous pipe having a plurality of looped segments optimized for surface area coverage provided for optimized thermo-conduction from a flowing fluid circulating through the pipe network toward plate holding member 140 and thereon plate 18, as shown. Pipe network 130 may be configured to have a plurality segments for example including but not limited to horizontal loop and/or weave and/or labyrinth and/or piping network as shown. Optionally and preferably pipe network 130 comprises a plurality of aligned straight segments that are coupled with 180 degree curved pipe segments.

Most preferably pipe network 130,130*p* may be provided from thermally conductive materials, for example including but not limited to metal, metal alloys, copper, aluminum and any combination thereof, or like materials having thermal conductive properties.

Most preferably a flowing fluid is circulated through network 130 from a flowing fluid reservoir 20 with the assistance of fluid pump, coupled with pump tubing and/or piping 24. Most preferably pipe network 130 is access via upper inlet/outlet 134 and lower inlet/outlet 132. Optionally piping 24 may be coupled to inlet/outlet 132,134 via a pipe coupler. Optionally either of upper pipe network opening 134 or lower pipe network opening 132 may serve as respective inlet and/or outlet for pipe network 130. Most preferably openings 134,132 are disposed about the same end of holder 100, shown here about second end 102.

Optionally and more preferably pipe network 130 is provided with an integrated pipe couplers 132*c*, 134*c* disposed about inlet/outlet 132,134, as shown in FIG. 6C-D and FIG. 10A-C.

Figure 6B:
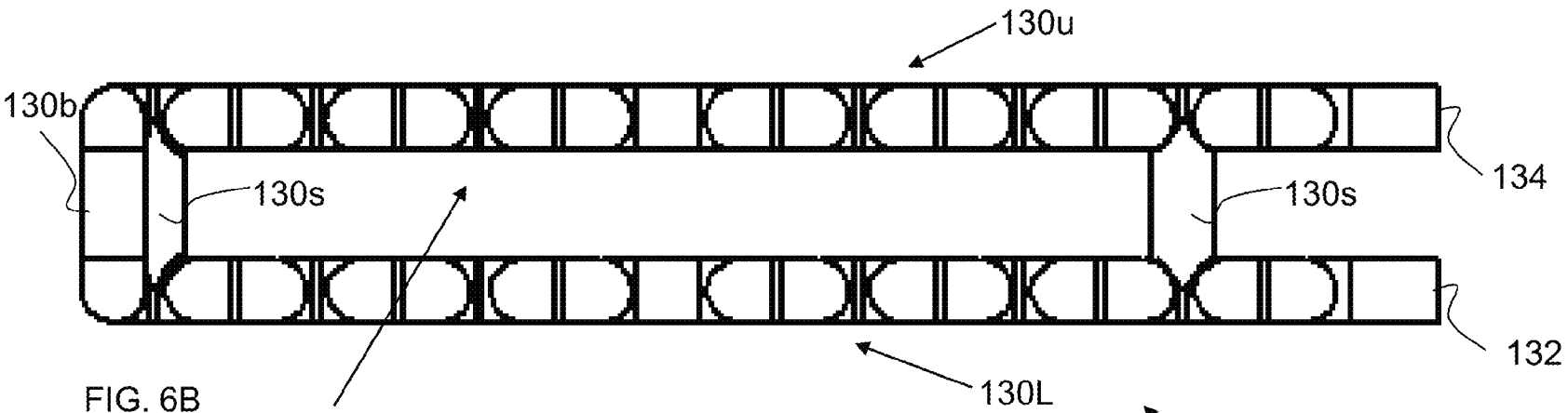
FIG. 6A-D are varying views of a schematic illustrative diagram of an optional pipe network according to an optional embodiment of the present invention, utilized with an exemplary device of the present invention, according to an optional embodiment of the present invention.
Figure 6A:
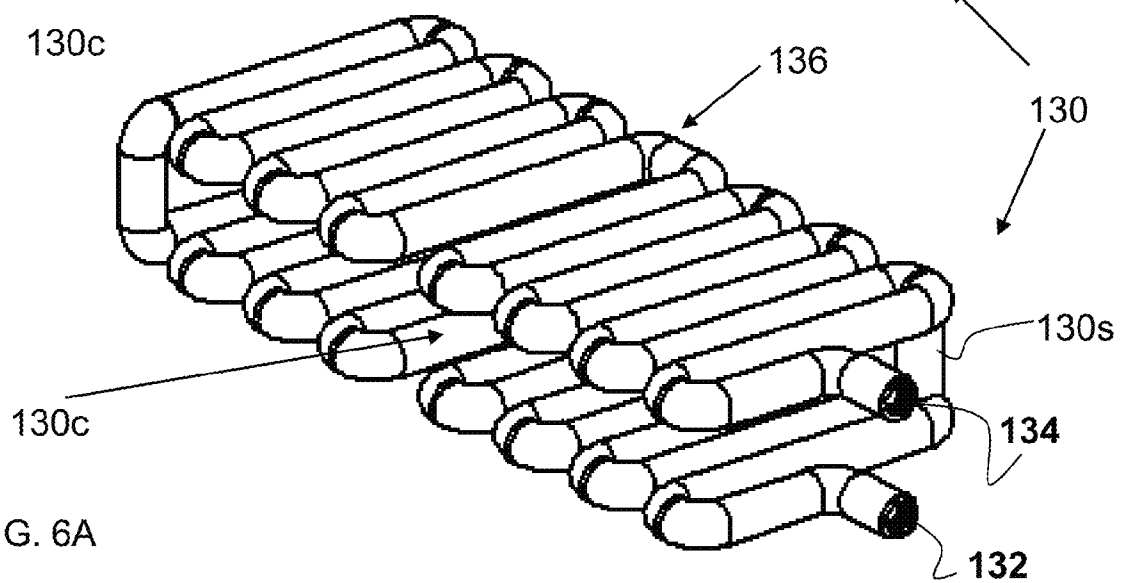

FIG. 6A-B show an optional and most preferable pipe network 130. FIG. 6A show a perspective view of pipe network 130 while FIG. 6B shows a side view of network 130. Most preferably network 130 comprises a continuous piping network having an upper network 130U and a lower network 130L that are continuous with one another from inlet/outlet 134 to inlet/outlet 132. Network 130 shown in FIG. 6A comprises one pipe bridge segment 130*b* and one support member 130*s* disposed on opposite sides of network 130. Most preferably bridge segment 130*b* may be disposed about first end 104, while support member 130*s* may be disposed about second end 102. Most preferably bridge member 130*b* and support member 130*s* define pipe network cavity 130*c*, as shown in FIG. 6B. Most preferably pipe network 130 is configured to be snuggly and tightly fit with plate holding member 140 so as to optimize thermal conductivity from pipe network 140 toward holding member 140 and onto plate 18.

Figures 6C, 6D:
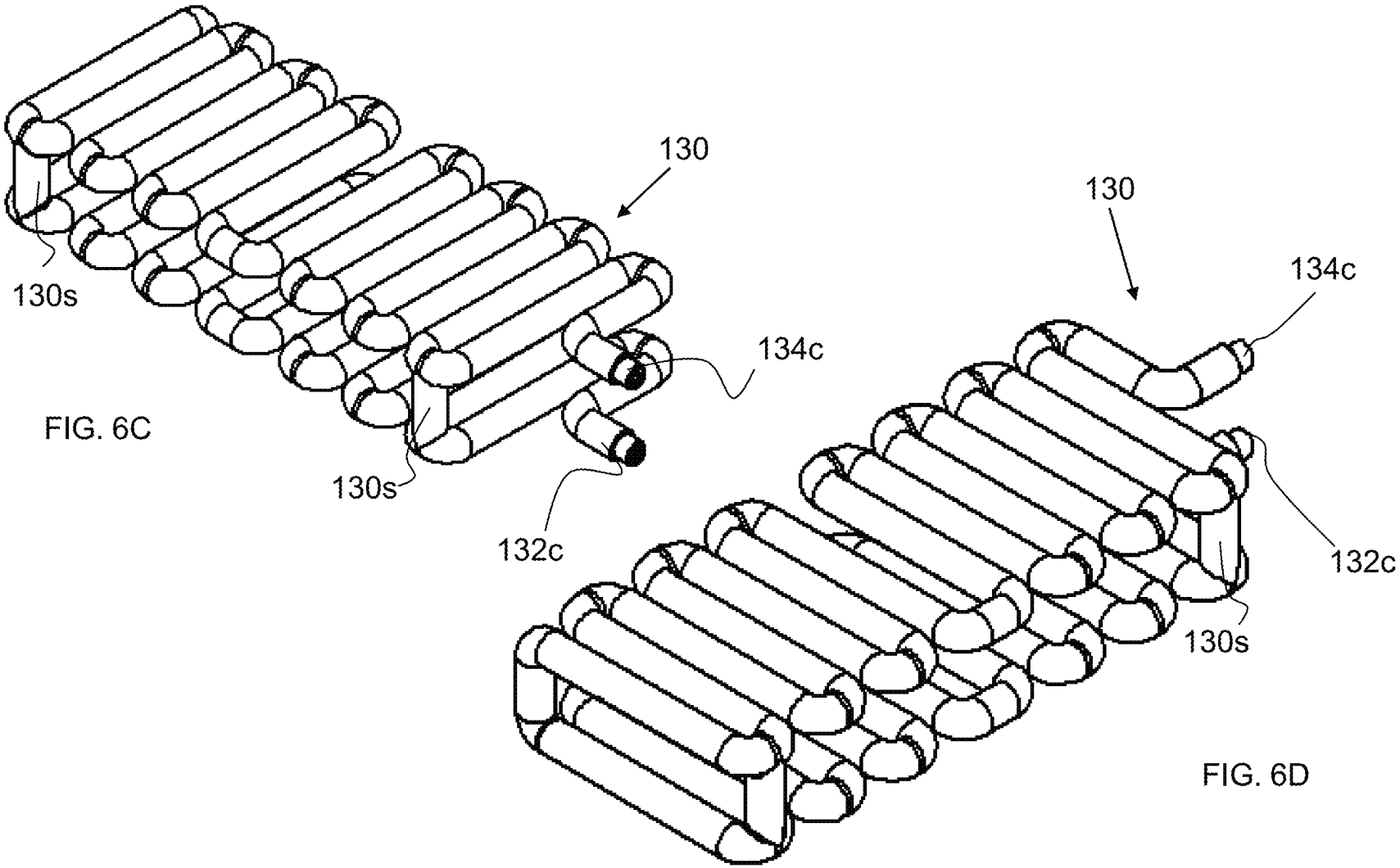

FIG. 6C-D show pipe network 130 of FIG. 6A-B fit with integrated pipe couplers 134*c* and 132*c* as previously described.

FIGS. 7A-C show an optional embodiment of pipe network 130 according to an optional embodiment of the present invention. FIG. 7A provides a planar view of upper pipe network segment 130*u*, as previously described, further depicting inlet/outlet 134 and recess 136.

FIG. 7B shows a perspective view of pipe network 130 from the first end, revealing a plurality of optional pipe projections 138. FIG. 7C provides a side view of pipe network 130 comprising optional pipe projections 138 according to an optional embodiment of the present invention.

Most preferably short projections 138 extend from the internal surface of pipe network 130 toward pipe cavity 130*c* and plate holding member 140. Most preferably, optional projections 138 provide for increasing the surface area available for thermo-coupling and provide for approximating pipe network 130 with plate holding member 140.

Figure 8B:
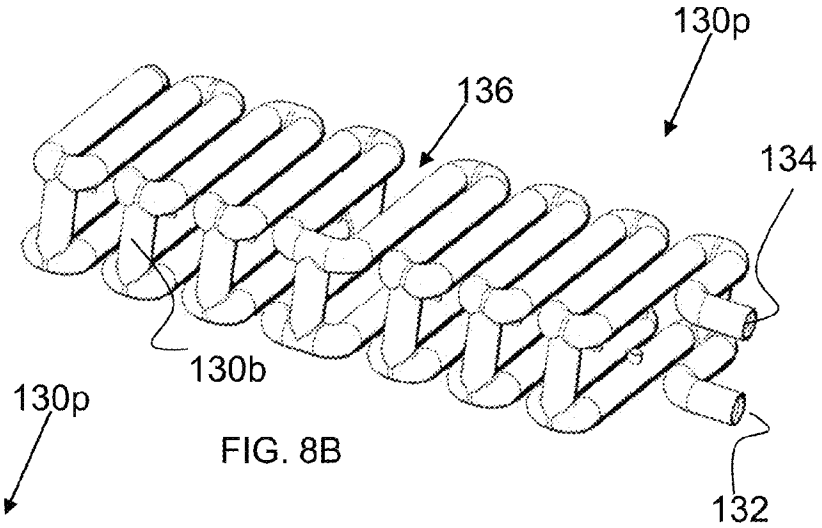
FIG. 8A-C are varying views of a schematic illustrative diagram of an optional pipe network according to an optional embodiment of the present invention, utilized with an exemplary device of the present invention, according to an optional embodiment of the present invention.
Figure 8A:
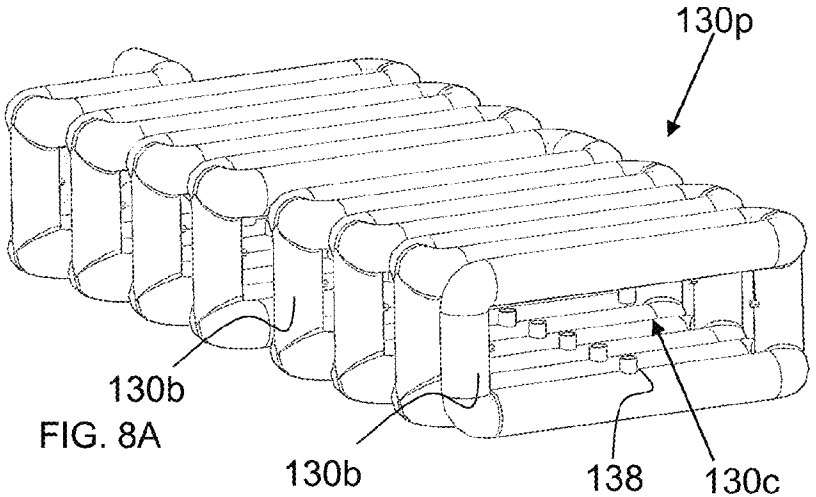
Figure 8C:
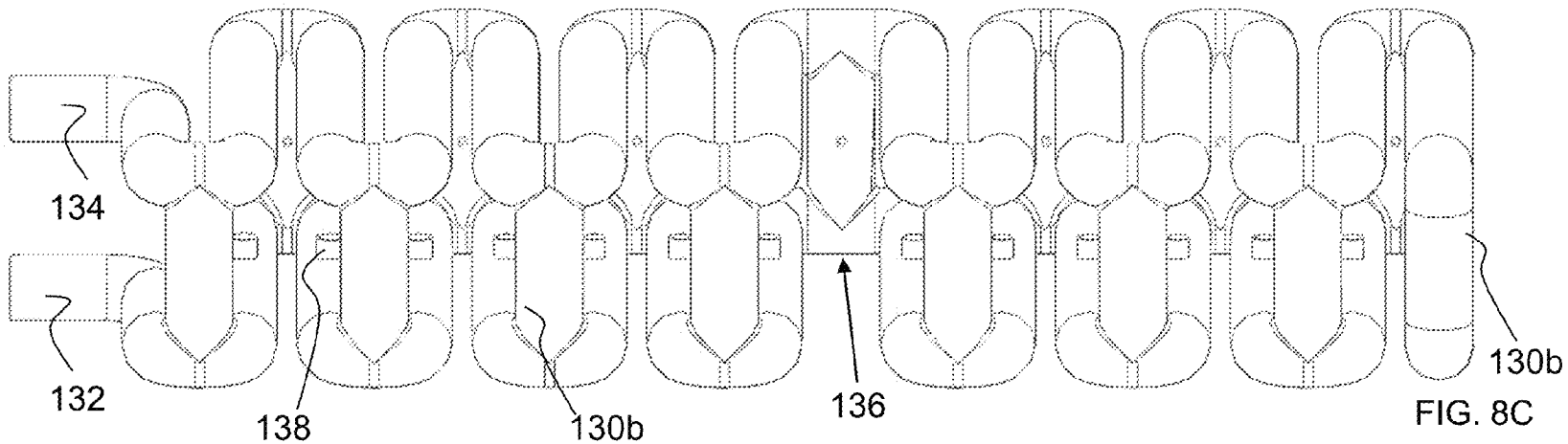

FIGS. 8A-C show a still further optional embodiment of pipe network 130, namely pipe network 130*p* that is adapted and configured to circulate a flowing fluid about the perimeter of holding member 140, according to the present invention. Pipe network 130*p* depicted in FIG. 8A-C, provides for circulating a flowing fluid about more than two surfaces of holding member 140. Pipe network 130*p* comprise a plurality of bridging segments 130*b* therein coupling upper network 130*u* and lower network 130L at a plurality of junctures. Optionally and preferably such configuration provides for circulating a flowing fluid about the upper and lower surfaces of holding member 140, as provided by pipe network 130 as previously described and further circulating a flowing fluid between adjacent bridging segments disposed on either side of pipe network 130*p*, as shown. Pipe network 130*p* and preferably provides for circulating a flowing fluid about the perimeter of plate holding member 140.

Figure 9A:
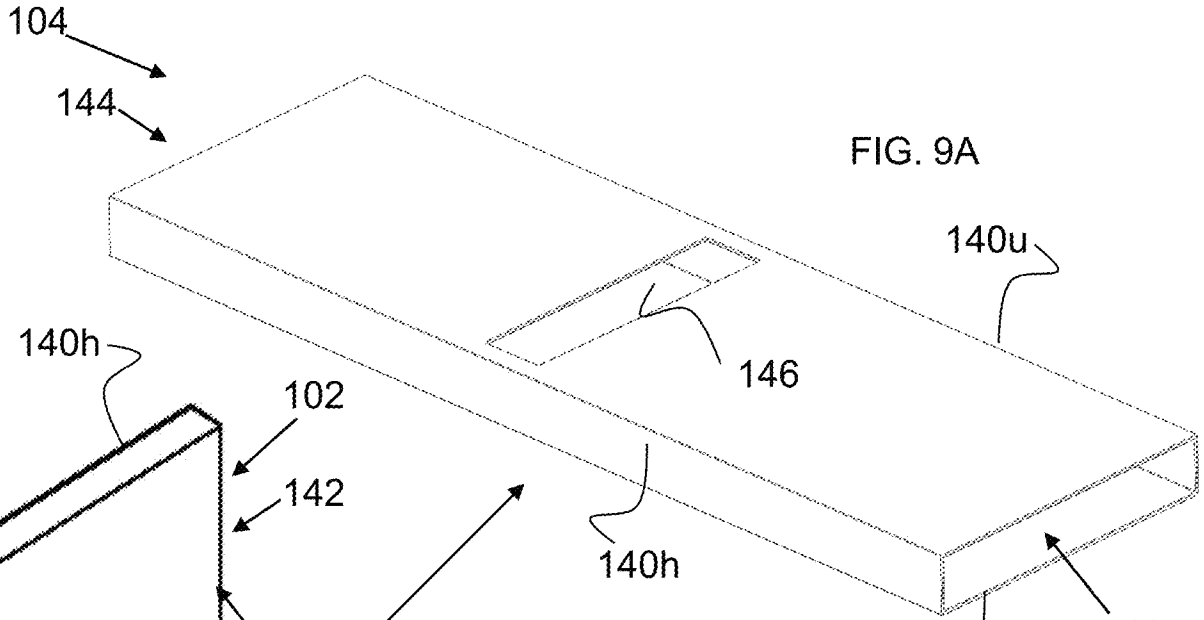
FIG. 9A-B are varying views of a schematic illustrative diagram of a preferred plate holding member according to an optional embodiment of the present invention, utilized with an exemplary device of the present invention, according to an optional embodiment of the present invention.
Figure 9B:
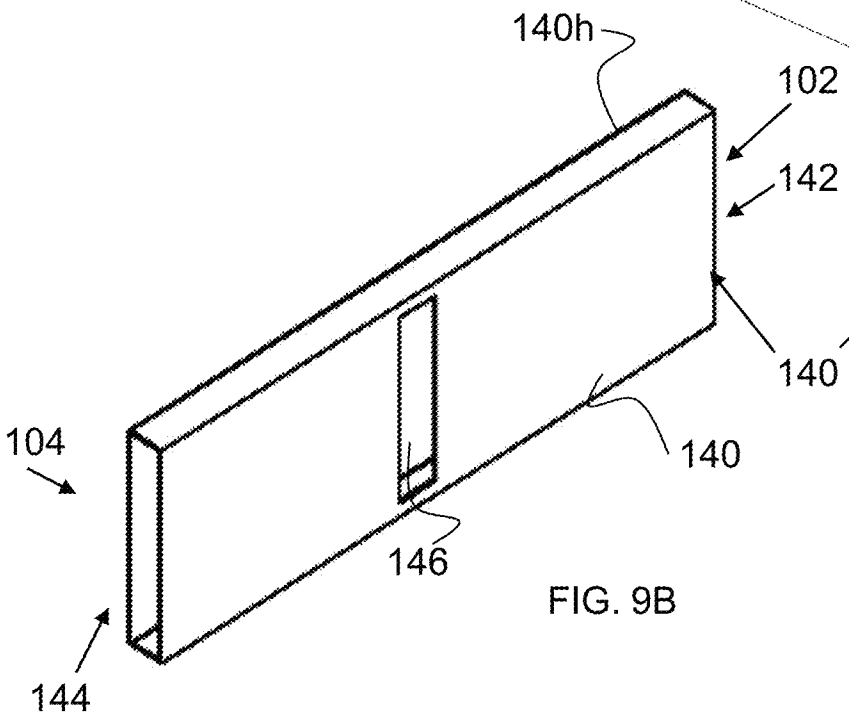

Referring now to FIGS. 9A-B showing perspective views of plate holding member 140. Plate holding member is most preferably provided for receiving an associating with an experimental plate 18. Plate holding member 140 is optionally provided with a substantially rectangular box shape, as shown, however member 140, therein configured to receive and associate with most multi-well reaction plate 18, generally provided in a rectangular shape having 12×8 configuration. Plate holding member 140 is not limited to such a rectangular shape. Optionally plate holding member 140 may be configured to have any size and shape capable and adapted to fit any form, size or shape of a reaction plate requiring temperature control that surrounds the reaction plate about at least two surfaced and optionally about two or more surfaces.

Most preferably holding member 140 is configured to essentially seal experimental plate 18 within holding member 140. Therein most preferably holding member 140 provides for preventing and/or avoiding and/or minimizing unwanted interactions with potential airborne contaminants, while maintaining experimental plate 18 at a controllable temperature, environment, and minimizing any evaporation from reaction plate 18. Airborne contaminants may for example include but is not limited to air, gasses, vapor, aerosols, moisture, dust, or the like.

Most preferably holding member 140 may further be configured to provide for seamless loading and/or receiving of plate 18 into cavity 140*c*.

Most preferably holding member 140 may further be configured to provide for easily maneuvering plate 18 between a first end 104 and second to end 102, through the length of member 140 through cavity 140*c*.

Optionally and preferably holding member 140 is provided with a length that is at least twice as long as the length of reaction plate 18, most preferably to allow a user to advance plate 18 about the length of holding member 140, between first end 104, 144 and second end 102, 142. Most preferably plate 18 may be sequentially advanced between first end 144,104 and second end 142, 102, over recess 146 forming a frame of window 106, therein gradually providing access to a limited portions of plate 18, for example a single column 18*c*, that disposed over window 106, as a user 14 loads individual wells 18*w* disposed about plate column 18*c*, while the remaining wells 18*s* remain sealed and thermally controlled within holding member 140.

Plate holding member 140 is optionally and preferably provided in the shape of a substantially rectangular box comprising an upper surface 140*u*, a lower surface 140L, two opposing openings 140*o*, and two opposing sides 140*h*, as shown. Most preferably upper surface 140*u* and lower surface 140L are parallel to one another and defined about the length of holding member 140. Most preferably the two surface 140*h* are parallel to one another and defined the closed sides and height of holding member 140.

Most preferably upper surface 140*h* provides for sealing plate 18, as previously described.

Most preferably holding member 140 is provided with an open cavity 140*c*, spanning the length of holding member 140, as shown. Most preferably holding member 140 is configured for receiving and holding an experimental plate 18, through opening 140*o*. Most preferably experimental plate 18 may be loaded and/or associated with holding member 140 through two opening on opposite sides disposed about is short side 140*o*.

Most preferably holding member 140 comprises a recess 146 about its upper surface 140*u* forming part of window 106 as previously described.

Most preferably plate holding member 140 is provided from to thermally conductive materials, for example including but not limited to metal, metal alloys, copper, aluminum and any combination thereof, or like materials having thermal conductive properties.

Figures 10A, 10B, 10C:
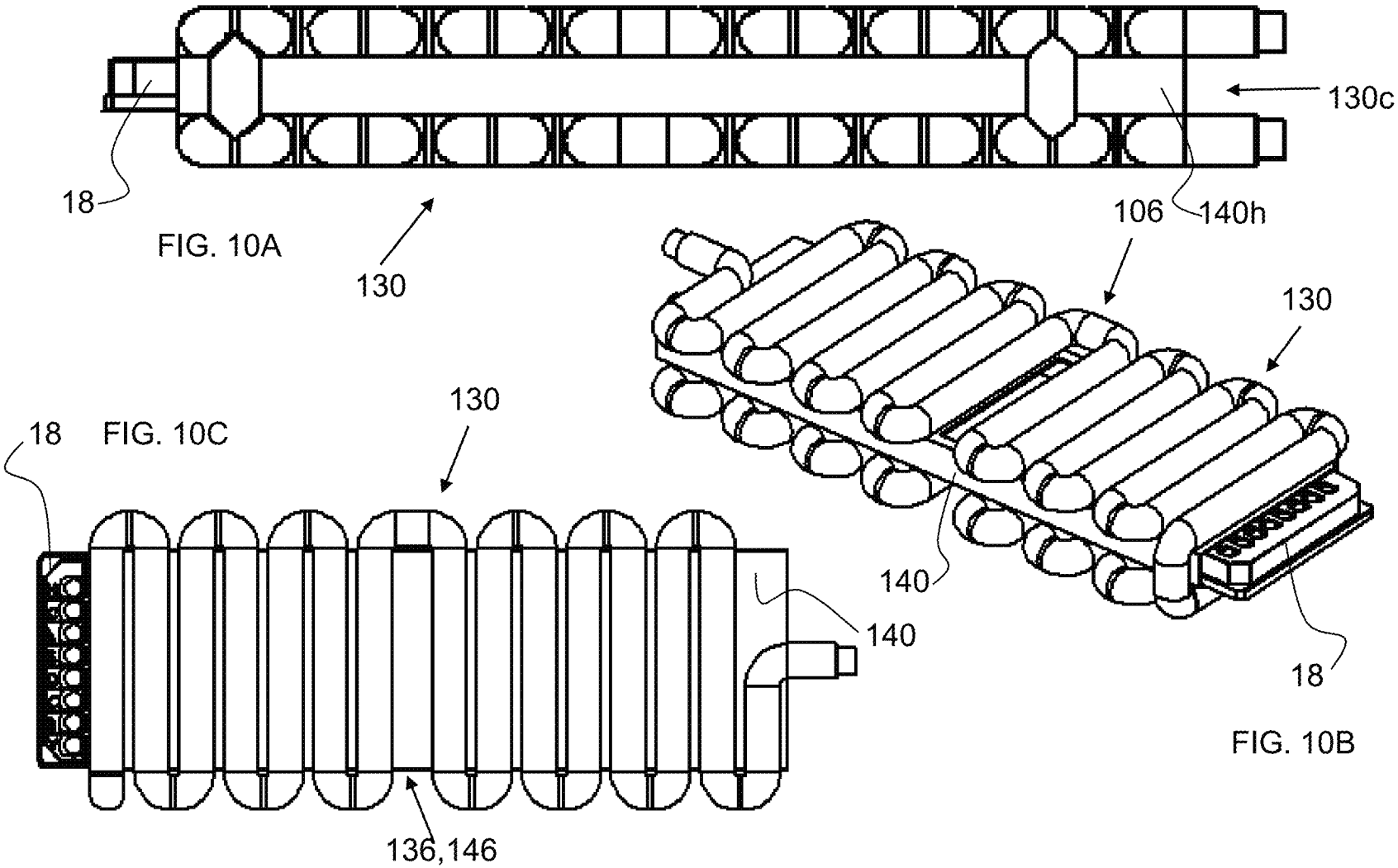
FIG. 10A-C are varying views of a schematic illustrative diagram of a assembly comprising an experimental plate associated within a plate holding member that are disposed within a pipe network according to an optional embodiment of the present invention of the present invention.

Most preferably plate holding member 140 is configured to associate and securely fit with pipe network 130, 130*p* within pipe cavity 130*c*, as shown in FIGS. 10A-C.

Referring now to FIGS. 10A-C depicting varying views of pipe network 130 associated with holding member 140 and experimental plate 18, as previously described. FIG. 10A shows plate 18 slightly extending from holding member 140. FIG. 10B shows the window 106 that most preferably provides for viewing and/or accessing at least a portion of plate 18, for example a well disposed therein.

FIG. 10A shows plate 18 being loaded and onto holding member 140 and extending therefrom, while holding member 140 is associated within pipe cavity 130*c* along its length. Optionally a user 14 may load plate 18 about a first open end of holding member 140 and slide it toward the second open end, optionally and most preferably with the sliding tool 118, as previously described.

Plate holder 100 optionally and preferably comprises lower housing 120 that may be securely fit with upper housing 110 forming housing 101. Most preferably housing 120 is provided from thermally insulating materials, for example including but not limited to a polymer, plastic, PVC, ABS, PP, PS, any combination thereof or the like.

Lower housing 120 most preferably comprises a lower housing recess 120*r* for receiving, associating and/or fitting pipe network 130. Most preferably housing 120 is provide with a pipe inlet/outlet recess 122 for receiving and/or fitting with pipe inlet/outlet 132.

Figure 11A:
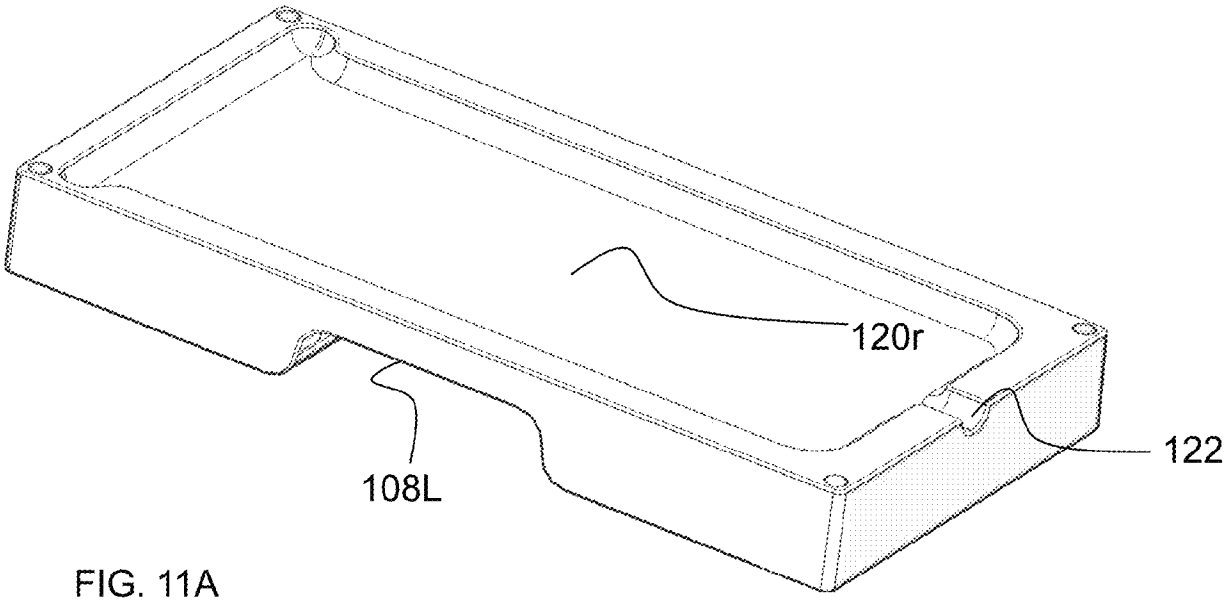
FIG. 11A-B are views of a schematic illustrative diagrams of optional lower housing of an exemplary device according to an optional embodiment of the present invention.

FIG. 11A shows as preferable and optional lower housing 120 comprising lower housing recess 120*r* for receiving and/or associating with pipe network 130 about the lower pipe network 130L.

Figure 11B:
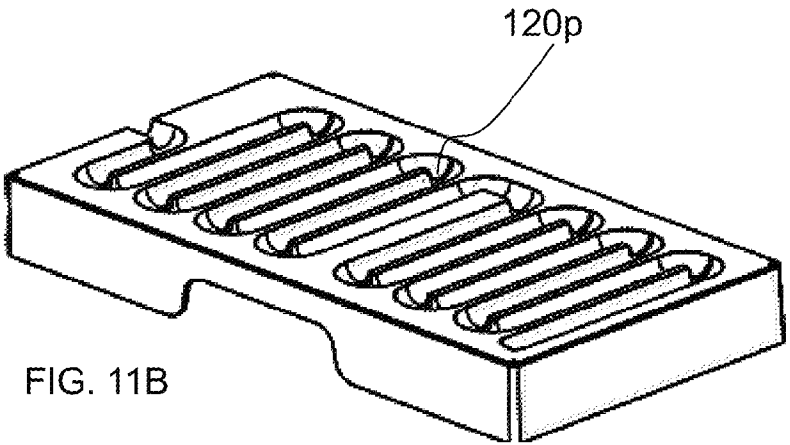

FIG. 11B shows an optional lower housing 120 comprising lower housing pipe fitting recess 120*p* for securely fitting receiving and/or associating with pipe network 130 about the lower pipe network 130L. Most preferably recess 120*p* is provided in a one to one configuration fitting exactly with lower pipe network 130L, wherein lower housing is molded to fit with lower pipe network 130L about recess 120*p*.

Optionally and preferably lower housing 120 comprises carrying recess 108L.

Optionally lower housing 120 may comprise insulating material fit between recess 120*r*, 120*p* and lower pipe network 130L, optionally provided to further insulate and maintain the core temperature within plate holder 100.

Figure 12:
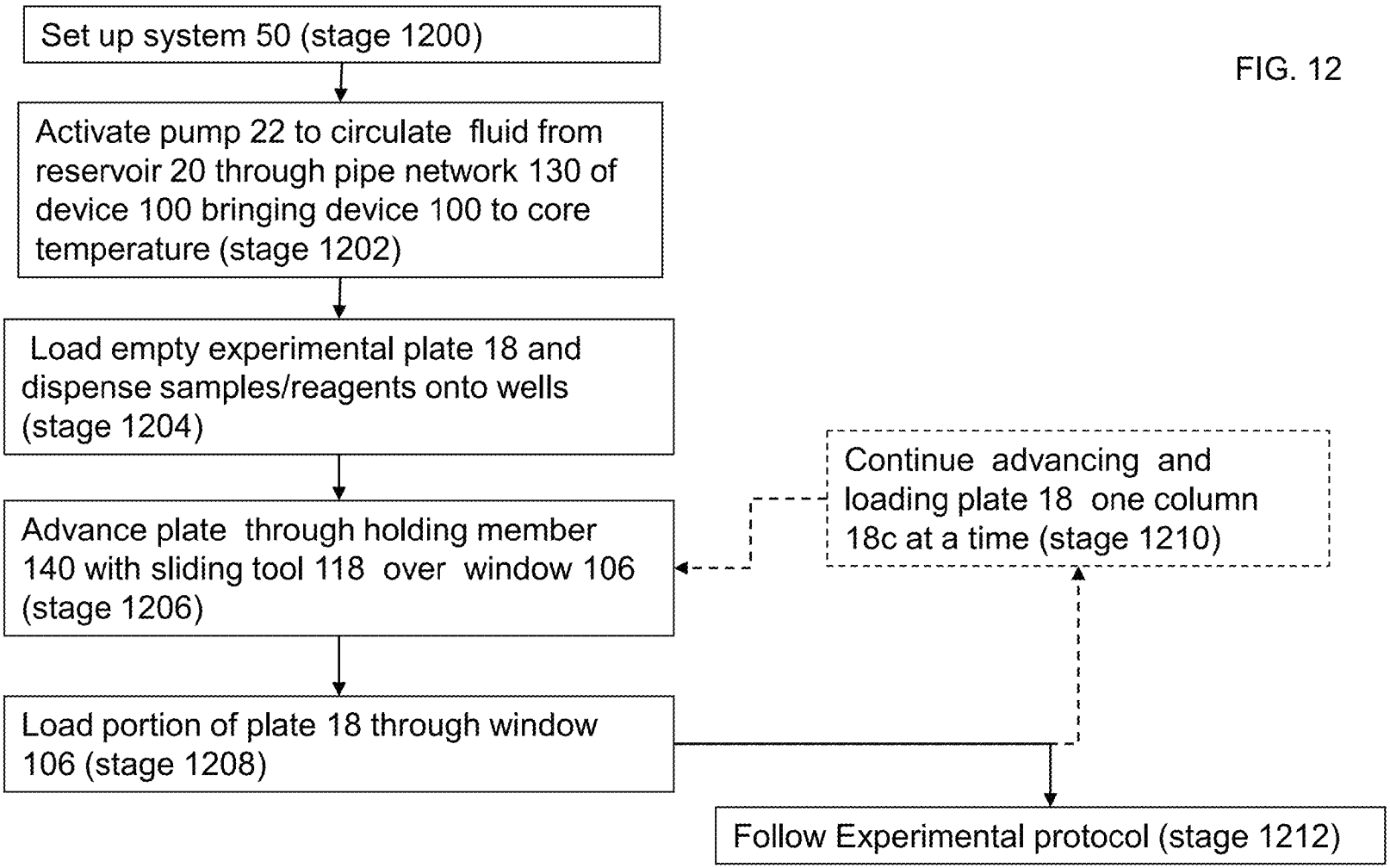
FIG. 12 is a flowchart of a method of use of the device according to an optional embodiment of the present invention.

FIG. 12 depicts a flowchart of an optional method of using device 100 within a laboratory setting 10 as previously described and depicted in FIG. 1A. First in stage 1200, system 50 as previously described is set up. Most preferably comprising connecting device 100 to fluid pump 22 by coupling pipe network 24 to pipe network 130, optionally and preferably through pipe coupling 132*c* and 134*c*, so as to have a closed loop flowing fluid circulation between and reservoir 20, pump 22 and device 100. Most preferably reservoir 20 comprises a temperature controllable flowing.

Next in stage 1202, system 50 is activated by activating pump 22 to circulate fluid from reservoir 20 through pipe network 130 of device 100 allowing device 100 to reach a core controllable temperature. Most preferably the core temperature is preferably determined by the temperature of a flowing fluid and the temperature controlled with reservoir 20.

Optionally, plate holder 100 may be primed to a particular temperature prior to use with system 50. For example, device 100 may be placed in an incubator and/or freezer to obtain a required core temperature. prior to use with system 50, as previously described above.

Optionally plate holder 100 may be used independently of system 50, therein optionally not performing stages 1200 and 1202, for example without coupling with reservoir 20 and pump 22. For example, device 100 may be utilized at room temperature, and/or placed in an incubator and/or freezer to obtain a required core temperature.

Next in stage 1204, an empty experimental plate 18 is loaded and/or associated within plate holding member 140, most preferably through a first end 104/144 or second end 102/142. Optionally some reaction plate wells 18*w* disposed on plate 18 may be loaded and/or dispensed with a sample and/or reagents, and/or analyte prior to associating plate 18 with plate holder 101, as required by an optional experimental protocol.

Next in stage 1206, plate 18 is advanced through holding member 140 optionally and most preferably with sliding tool 118 so as to bring at least a portion of plate 18 and more preferably a first single column of plate 18*w* over window 106.

Next in stage 1208, the portion of plate 18 exposed and/or disposed under viewing/working window 106, most preferably wells disposed about a first single plate column 18*c*, are dispensed and/or loaded with a sample and/or reagents, and/or analyte as required by an experimental protocol. Therein exposing only the necessary wells and/or portion of plate 18 while maintain the remaining portion of plate 18 sealed so as to prevent evaporation and/or contamination from airborne contaminants, as previously described. Optionally loading and/or dispensing samples within plate 18 is optionally and most preferably provided with pipette 16, as previously described.

Next in optional stage 1210, plate 18 is advanced past window 106 to expose a new portion of plate 18 and most preferably a second single column of wells is placed within working window, therein repeating stages 1206 and 1208 until plate 18 is loaded as required according to the experimental protocol. Most preferably plate 18 is thereafter advanced from first end 104 to second end 102 of plate holder 100, sequentially one plate column 18*w* at a time.

Lastly, once plate 18 is dispensed and/or loaded as necessary the experimental protocol may followed as necessary. Optionally, plate 18 may be stored and/or maintained within plate holder 100 for an unlimited period of time, and/or as required, most preferably while maintaining plate 18 under controllable conditions. Most preferably such controllable conditions may for example include but are not limited to, preventing unwanted interactions with potential airborne contaminants, maintaining experimental plate 18 at a controllable temperature, and minimizing any evaporation from reaction plate 18, as previously described.

While the invention has been described with respect to a limited number of embodiment, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not described to limit the invention to the exact construction and operation shown and described and accordingly, all suitable modifications and equivalents may be resorted to, falling within the scope of the invention.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

Further modifications of the invention will also occur to persons skilled in the art and all such are deemed to fall within the spirit and scope of the invention as defined by the appended claims.

While the invention has been described with respect to a limited number of embodiments, it will be appreciated that many variations, modifications and other applications of the invention may be made.

What is claimed is:

1. A device for maintaining and controlling the environment surrounding an experimental plate providing for thermal control, minimizing evaporation and exposure to airborne contaminants the device comprising:

a) a plate holding member having a holding member cavity for receiving and holding said experimental plate, providing for minimizing evaporation and exposure to airborne contaminants about said plate; wherein said plate holding member comprises at least a top outside surface and a bottom outside surface;

b) a continuous pipe network, defining a pipe network cavity for housing said plate holding member, wherein said pipe network surrounds said plate holding member about at least said top and bottom outside surfaces and wherein said pipe network provides for circulating a temperature controlled flowing fluid about said at least top and bottom outside surfaces of said plate holding member, therein providing for thermal control about said plate holding member and said experimental plate disposed within said holding member cavity of said plate holding member; said pipe network comprising an upper pipe network portion disposed over said top outside surface and a lower pipe network portion disposed below said bottom outside surface of said plate holding member; and c) an external housing for encasing said pipe network; said external housing having at least one recess provided for gaining accessing to said plate holder cavity.

2. The device of claim 1 wherein said external housing comprises at least two recesses for gaining accessing to said plate holder cavity, and wherein said at least two recesses are disposed about opposite surfaces of said external housing, forming a continuous opening spanning the length of the device.

3. The device of claim 1 wherein each of said external housing, piping network, and plate holding member comprise a plate viewing recess configured to be aligned with one another defining a plate viewing window, provided for viewing and gaining access to at least a portion of said plate while said plate is associated with said plate holding member.

4. The device of claim 1 wherein said pipe network further comprises short projections extending from the pipe network surface toward said pipe cavity and said plate holding member.

5. The device of claim 1 wherein said pipe network further comprises a plurality of side pipe segment bridging said upper and lower pipe networks about the length of said pipe network therein circulating a flowing fluid about the perimeter of said plate holding member.

6. The device of claim 1 wherein said continuous pipe network further comprises at least one pipe bridging segment and wherein said pipe network cavity is defined by said upper pipe network portion, said lower pipe network portion, and said at least one pipe bridging segment such that said continuous pipe network is essentially wound about said plate holding member which is housed within said pipe network cavity.

7. The device of claim 1 wherein said external housing further comprises thermally insulating materials.

8. The device of claim 1 wherein said external housing further comprises a thermally insulating polymer selected from the group consisting of PVC, ABS, PP, PS, or any combination thereof.

9. The device of claim 1 wherein said pipe network or said plate holding member further comprise thermally conducting materials selected from the group consisting of metal, metal alloys, copper, aluminum and any combination thereof.

10. The device of claim 1 further comprising insulating materials interfacing said pipe network and the internal surface of said external housing.

11. The device of claim 1 adapted to provide an auxiliary device with access to at least a portion of said plate while said plate is associated with said plate holding member.

12. The device of claim 11 wherein said auxiliary device is selected from the group consisting of a sampling robot, a pipette, an imaging device, a microscope.

13. The device of claim 1 wherein said external housing is configured to associate with an auxiliary device.

14. The device of claim 13 wherein said auxiliary device is selected from the group consisting of a sampling robot, robotic arm, a pipette, an imaging device, a microscope, syringe, piston operated syringe or any combination thereof.

15. The device of claim 3 further comprising a cover that may be disposed to cover said viewing window.

16. The device of claim 15 wherein said cover provides selective access to a portion of said plate.

17. The device of claim 16 wherein said portion of said plate comprises individual cells within a said viewing window.

18. A system for controlling the temperature surrounding an experimental plate, the system comprising a device according to claim 1 wherein said pipe network is associated with a fluid pump for circulating a flowing fluid through said pipe network wherein said flowing fluid is pumped from a temperature controllable reservoir with said fluid pump.

19. The system of claim 18 further comprising an auxiliary device for accessing and obtaining a sample from at least a portion of said plate through a viewing window.

20. The system of claim 19 wherein said auxiliary device is selected from the group from the group consisting of a sampling robot, robotic arm, a pipette, an imaging device, a microscope, syringe, piston operated syringe or any combination thereof.

21. The device of claim 1 wherein said pipe network and said plate holding member further comprise thermally conductive material.

* * * * *